US007547496B2

(12) United States Patent
Asano et al.

(10) Patent No.: US 7,547,496 B2
(45) **Date of Patent: *Jun. 16, 2009**

(54) IMAGE FORMING METHOD AND AN IMAGE FORMING APPARATUS

(75) Inventors: Masao Asano, Tokyo (JP); Kageyuki Tomoyori, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 406 days.

This patent is subject to a terminal disclaimer.

(21) Appl. No.: 10/971,995

(22) Filed: Oct. 22, 2004

(65) Prior Publication Data

US 2006/0088776 A1 Apr. 27, 2006

(51) Int. Cl.
*G03G 15/01* (2006.01)

(52) U.S. Cl. ..... 430/45.1; 430/125.3; 430/126.2

(58) Field of Classification Search ..... 430/125, 430/126, 45, 125.3, 126.2, 45.1
See application file for complete search history.

(56) References Cited

U.S. PATENT DOCUMENTS

| | | | | |
|---|---|---|---|---|
| 4,987,046 | A * | 1/1991 | Kutami et al. | 430/127 |
| 5,510,886 | A | 4/1996 | Sugimoto et al. | |
| 7,183,035 | B2 * | 2/2007 | Tomoyori | 430/120 |
| 2001/0051270 | A1 * | 12/2001 | Yamashita et al. | 428/405 |
| 2003/0054269 | A1 * | 3/2003 | Yamazaki et al. | 430/45 |
| 2003/0157421 | A1 * | 8/2003 | Matsushima et al. | 430/124 |
| 2004/0072093 | A1 * | 4/2004 | Itami | 430/125 |
| 2004/0183885 | A1 * | 9/2004 | Hoshizaki et al. | 347/129 |
| 2005/0271967 | A1 * | 12/2005 | Asano et al. | 430/120 |

FOREIGN PATENT DOCUMENTS

| | | | |
|---|---|---|---|
| JP | 06-332324 | A | 12/1994 |
| JP | 06-337598 | A | 12/1994 |
| JP | 07271142 | A | 10/1995 |

* cited by examiner

*Primary Examiner*—Mark F Huff
*Assistant Examiner*—Rachel L Burney
(74) *Attorney, Agent, or Firm*—Frishauf, Holtz, Goodman & Chick, P.C.

(57) ABSTRACT

An image forming method comprising:

developing a latent image formed on a cylindrical electrophotographic photoreceptor having a cylindricity of 5 to 40 μm, with a developer comprising toner in which a ratio Dv50/Dp50 of a 50% volume particle diameter Dv50 to a 50% number particle diameter Dp50 is 1.0 to 1.15, a ratio Dv75/Dp75 of a cumulative 75% volume particle diameter from the largest volume particle diameter Dv75, to a cumulative 75% number particle diameter from the largest number particle diameter Dp75, is 1.0 to 1.20, and the number of toner particles having a particle diameter of 0.7×Dp50 or less is 10 percent by number or less, to form a toner image; and transferring the toner image from the photoreceptor to an intermediate transferring member, is disclosed.

18 Claims, 7 Drawing Sheets

FIG. 7 ( a )
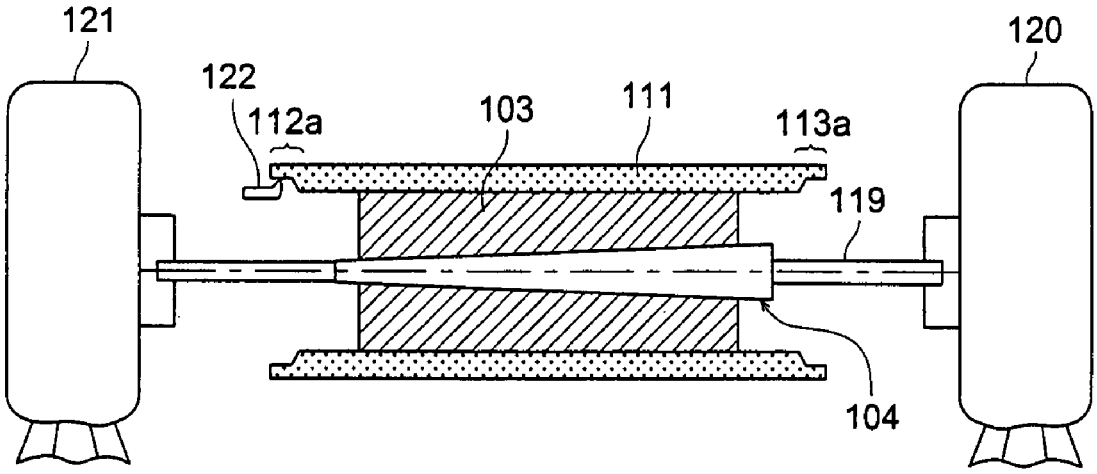
FIG. 7 ( b )
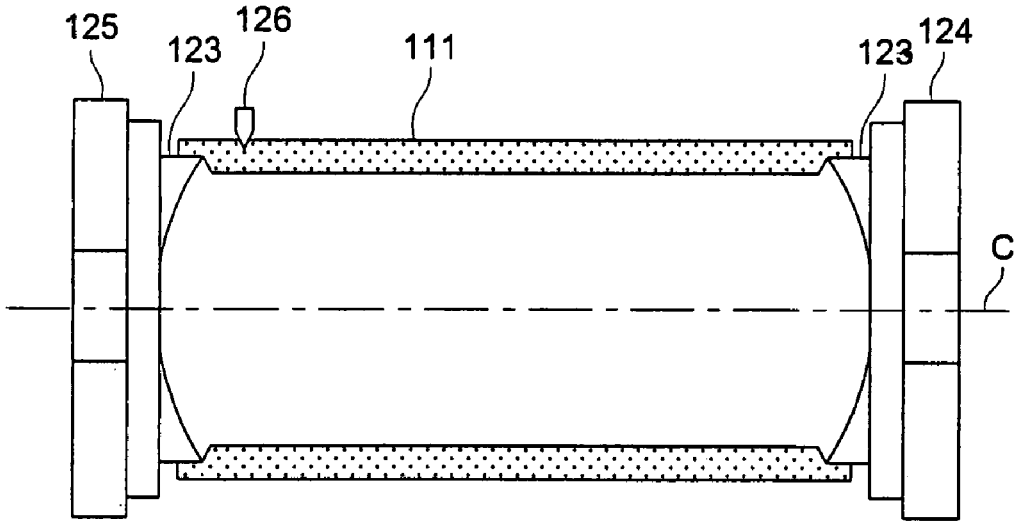

FIG. 8 ( a )
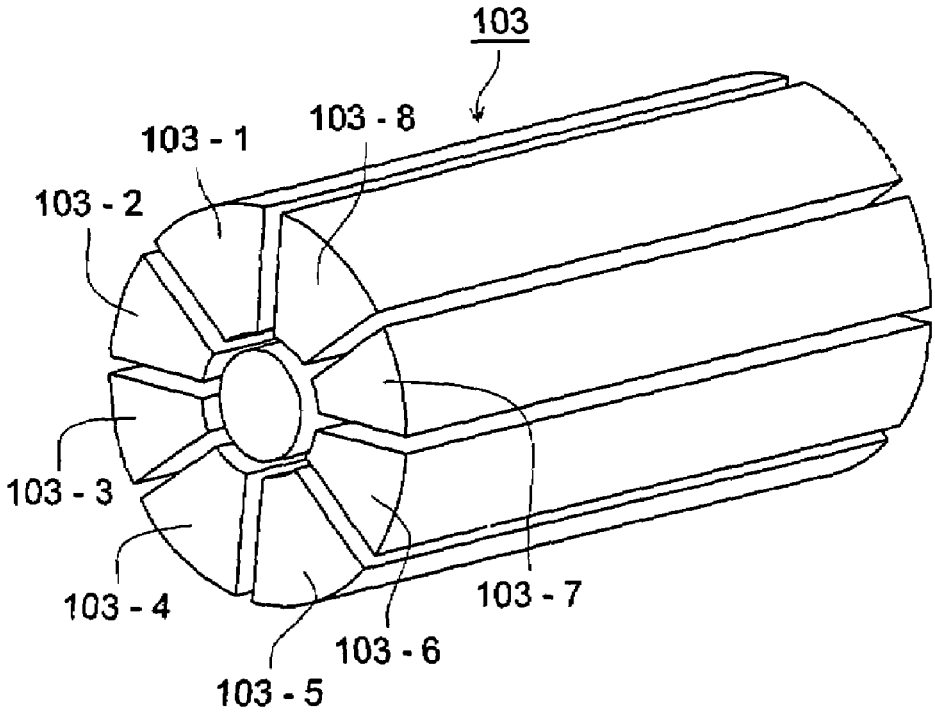
FIG. 8 ( b )
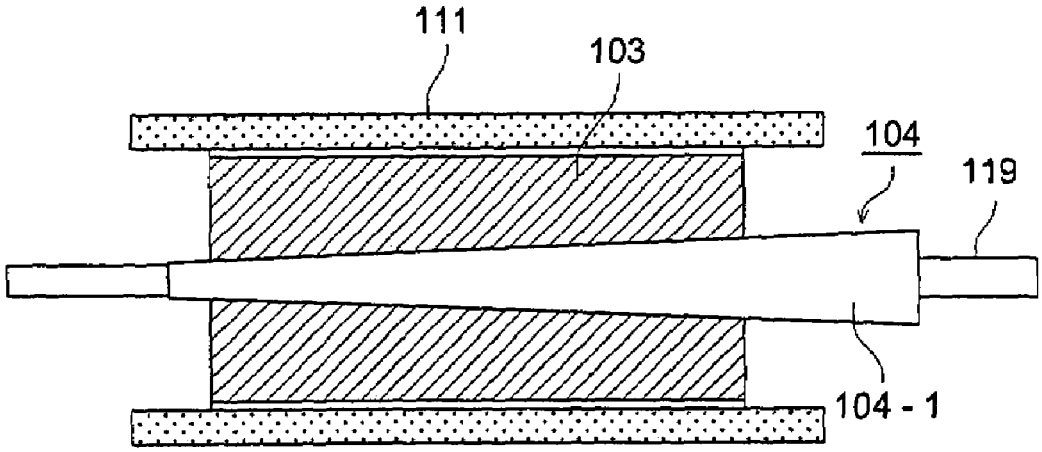

IMAGE FORMING METHOD AND AN IMAGE FORMING APPARATUS

TECHNICAL FIELD

The invention relates to an image forming method and an image forming apparatus for use in an electrophotographic copying machine, printer or facsimile etc.

RELATED ART

Heretofore, as a method in which an organic photoreceptor (hereinafter, also simply referred to as a photoreceptor) as an electrophotographic photoreceptor and a toner image formed on said organic photoreceptor is transferred onto a recording sheet for a final image, known is one to directly transfer a toner image having been formed on an organic photoreceptor onto a recording sheet. On the other hand, there is known an image forming method utilizing an intermediate transfer member, and this method is provided with one more transferring process in the transferring process of a toner image from an organic photoreceptor to a recording sheet so that a primary transferred image was secondarily transferred on an intermediate transfer member on to a recording sheet after transferring a toner image from an organic photoreceptor to an intermediate transfer member, resulting in formation of a final image. Among them, the above image forming method utilizing an intermediate transfer member is often employed as a cumulative transfer method of each color toner image in a so-called full-color image forming apparatus, in which an original image, having been subjected to color separation, is reproduced by means of subtractive mixture by use of such as black, cyan, magenta and yellow toners.

However, there caused new problems related to an intermediate transfer member in the above intermediate transfer method. One of the problems includes generation of uneven transfer or image defects such as so-called "hollow characters", in which a part of character image is lacking, due to variation of transfer or partial insufficient transfer in toner transfer onto an intermediate transfer member, which are caused by non-uniform pressing pressure at the contact interface between a photoreceptor and an intermediate transfer member, resulting in deterioration of sharpness.

On the other hand, to improve the secondary transfer property from an intermediate transfer member to a recording sheet, there disclosed a technique in which a solid lubricant is supplied on an intermediate transfer member to lower a surface energy of the intermediate transfer member. For example, there are techniques described in such as JP-A Nos. 6-337598, 6-332324 and 7-271142 (JP-A refers to Japanese Patent Publication Open to Public Inspection). However, such decrease of surface energy of the surface of an intermediate transfer member may also become, in turn, a cause to decrease a transfer ratio of toner from a photoreceptor to an intermediate transfer member, being insufficient to improve the total transfer property of an image forming method, which utilizes an intermediate transfer member and is provided with two times of transfer processes, and in particular, it has been found that further improvements with respect to copy image formation at high temperature and high humidity or over an extended period of time are required.

That is, it has been found that, in an image forming method utilizing an intermediate transfer member, required are to improve surface properties of the both of an organic photoreceptor and an intermediate transfer member and to improve the total transfer property in both of primary transfer and secondary transfer.

An object of one aspect of the invention can be to provide an image forming method and an image forming apparatus capable of forming an electrophotographic image, in which image deterioration such as uneven transfer, hollow characters and scattering of characters can be prevented so that sharpness is improved, as well as to provide an image forming method and an image forming apparatus which can prevent image deterioration such as uneven transfer, hollow characters and scattering of characters, which are liable to be generated at the time of color accumulation of color toners on an intermediate transfer member, and resulting in excellent image formation.

SUMMARY

An image forming method comprising:

developing a latent image formed on a cylindrical electrophotographic photoreceptor having a cylindricity of 5 to 40 μm, with a developer comprising toner in which a ratio Dv50/Dp50 of a 50% volume particle diameter Dv50 to a 50% number particle diameter Dp50 is 1.0 to 1.15, a ratio Dv75/Dp75 of a cumulative 75% volume particle diameter from the largest volume particle diameter Dv75, to a cumulative 75% number particle diameter from the largest number particle diameter Dp75, is 1.0 to 1.20, and the number of toner particles having a particle diameter of 0.7×Dp50 or less is 10 percent by number or less, to form a toner image; and transferring the toner image from the photoreceptor to an intermediate transferring member.

BRIEF DESCRIPTION OF THE DRAWINGS

The present invention will become more fully understood from the detailed description given hereinbelow and the accompanying drawings which are given by way of illustration only, and thus are not intended as a definition of the limits of the present invention, and wherein;

FIGS. 7(*a*) and 7(*b*) show a production process of cylindrical substrate of the present embodiment in the order of processes of FIG. 7(*a*) and FIG. 7(*b*);

FIG. 8(*a*) is a perspective view of a supporting member;

FIG. 8(*b*) is a sectional view showing a pressure variator of the supporting member;

DETAIL DESCRIPTION OF EXEMPLARY EMBODIMENTS

Figure 1:
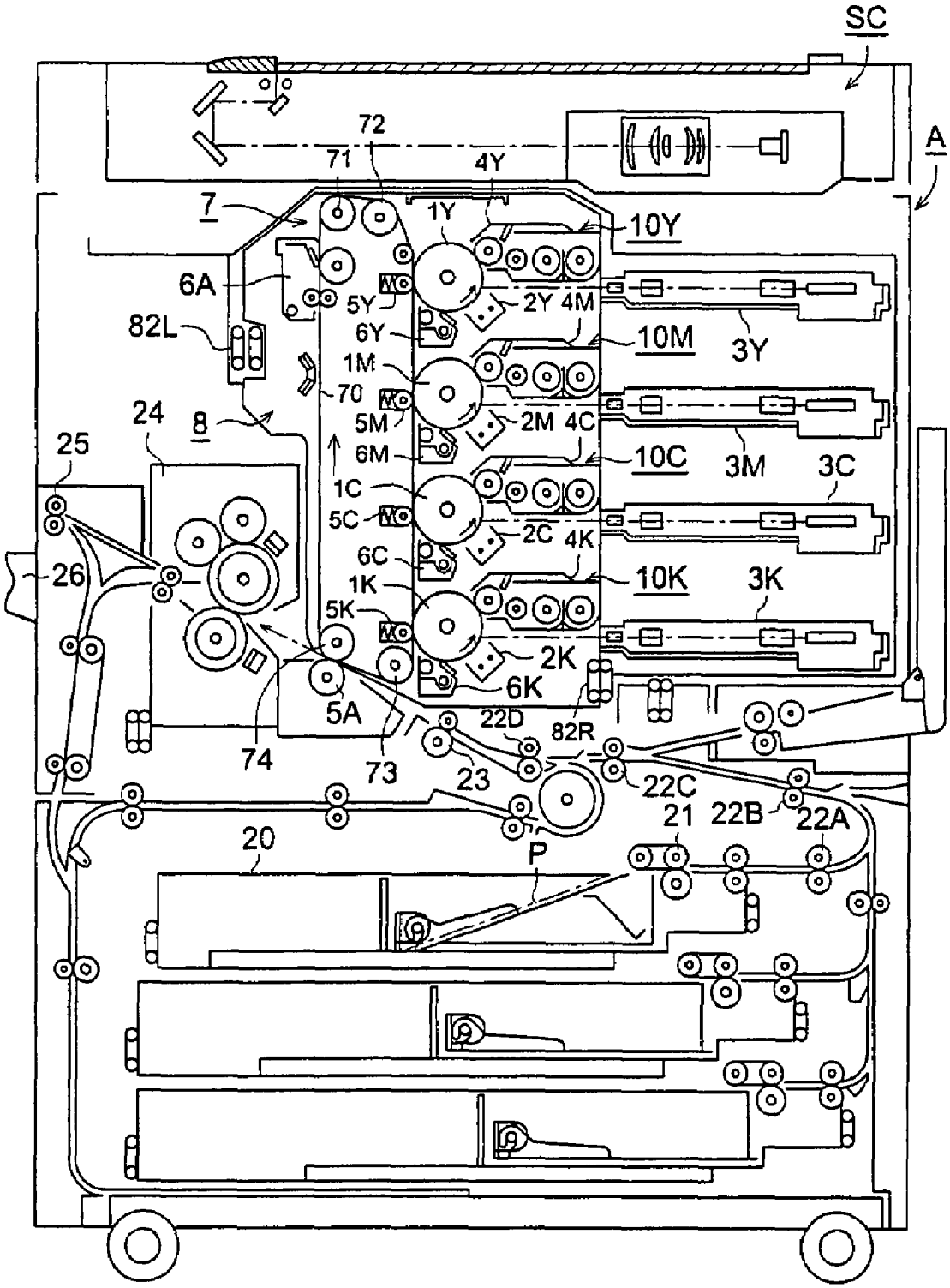
FIG. 1 is a sectional constitution drawing of a color image forming apparatus to show an embodiment of the present invention.

In the following, explanation will be made.

The inventors have found as a result of extensive studies that image deterioration such as uneven transfer often generated in an intermediate transfer method is effectively prevented by improving a dimension precision of an cylindrical organic photoreceptor utilized as a latent image carrier to prevent a variation of the surface pressure between a photoreceptor and an intermediate transfer member, thereby maintaining a transfer ratio at a constant value, in addition to this, by decreasing a small particle component in a toner particle size distribution and constituting, each range of a ratio of a 50% volume average particle diameter to a 50% number average particle diameter, which are medians of toner particle size distribution, and a range of a ratio of a cumulative 75% volume particle diameter from the largest volume particle diameter to a cumulative 75% number particle diameter from the largest number particle diameter, into a specified range.

The above point of view is also applicable to a color image formation. That is, in an image forming method comprising;

a process forming a latent image corresponding to a yellow image on a latent image carrying member, a process developing said latent image with a developer containing yellow toner and a process transferring a toner image formed on said latent image carrying member onto an intermediate transfer member;

a process forming a latent image corresponding to a magenta image on a latent image carrying member, a process developing said latent image with a developer containing magenta toner and a process transferring a toner image formed on said latent image carrying member onto an intermediate transfer member;

a process forming a latent image corresponding to a cyan image on a latent image carrying member, a process developing said latent image with a developer containing cyan toner and a process transferring a toner image formed on said latent image carrying member onto an intermediate transfer member;

a process forming a latent image corresponding to a black image on a latent image carrying member, a process developing said latent image with a developer containing black toner and a process transferring a toner image formed on said latent image carrying member onto an intermediate transfer member;

and a process transferring each color toner image formed by transfer on said intermediate transfer member onto a recording sheet, it is effective to utilize an organic photoreceptor having a cylindricity of 5-40 μm as said latent image carrying member, and yellow, magenta, cyan and black toners containing resin and colored particles as said each toner, which has a ratio (Dv50/Dp50) of a 50% volume average particle diameter (Dv50) to a 50% number average particle diameter (Dp50) of 1.0-1.15, a ratio (Dv75/Dp75) of a cumulative 75% volume particle diameter from the largest volume particle diameter (Dv75) to a cumulative 75% number particle diameter from the largest number particle diameter (Dp75) of 1.0-1.20 and the number of toner having a particle diameter of 0.7×(Dp50) or less being 10% by number or less.

The explanation will be made based on the exemplary embodiments below.

FIG. 1 is a cross-sectional constitution drawing of a color image forming apparatus showing an exemplary embodiment of the invention.

The color image forming apparatus is called as a tandem type color image forming apparatus and is comprised of plural sets of color image forming portions 10Y, 10M, 10C and 10K; endless belt-form intermediate transfer member unit 7; paper supply and transport means 21; and fixing means 24. Original image reading device SC is mounted on the head of main body A of an image forming apparatus.

Image forming portion 10Y, at which an image of yellow color is formed, is comprised of electric charging means 2Y, exposure means 3Y, development means 4Y, primary transfer roller 5Y as a primary transfer means and cleaning means 6Y, which are arranged at the surroundings of drum-form photoreceptor 1Y as the first image carrier. Image forming portion 10M, at which an image of magenta color is formed, is comprised of drum-form photoreceptor 1M as the first image carrier, electric charging means 2M, exposure means 3M, development means 4M, primary transfer roller 5M as a primary transfer means and cleaning means 6M. Image forming portion 10C, at which an image of cyan color is formed, is comprised of drum-form photoreceptor 1C as the first image carrier, electric charging means 2C, exposure means 3C, development means 4C, primary transfer roller 5C as a primary transfer means and cleaning means 6C. Image forming portion 10K, at which an image of black color is formed, is comprised of drum-form photoreceptor 1K as the first image carrier, electric charging means 2K, exposure means 3K, development means 4K, primary transfer roller 5K as a primary transfer means and cleaning means 6K.

Endless belt-form intermediate transfer member unit 7 is provided with endless belt-form transfer element 70 as a second image carrier of semi-conductive endless belt-form which is wound and held rotatable around plural rollers.

Each color image formed at image forming portions 10Y, 10M, 10C and 10K is transferred successively onto rotating endless belt-form intermediate transfer member 70 to form a synthesized color image. Paper P as a recording material (a support carrying a fixed final image: for example, a plain paper, a transparent sheet, etc.) stored in paper supply cassette 20 is supplied through paper supply means 21 followed by being transported through plural intermediate rollers 22A, 22B, 22C and 22D and register roller 23 to secondary transfer roller 5A as a secondary transfer means; and a color image is transferred collectively by a secondary transfer process on paper P. Paper P on which a color image has been transferred is subjected to a fixing treatment by fixing means 24, and is nipped by paper ejecting roller 25 to be placed on paper ejecting tray 26 outside of a machine.

On the other hand, endless belt-form intermediate transfer member 70, which is separated by curvature from paper P, is erased of a residual toner by cleaning means 6A after a color image is transferred onto paper P by secondary transfer roller 5A as a secondary transfer means.

During an image forming process, primary transfer roller 5K is always brought in pressing contact with photoreceptor 1K. Other primary transfer rollers 5Y, 5M and 5C are brought in pressing contact with corresponding photoreceptors 1Y, 1M and 1C respectively only when a color image is formed.

Secondary transfer roller 5A is pressing contacted with endless belt-form intermediate transfer member 70 only when a secondary transfer is performed by passing paper P therethrough.

Further, box element 8 is possible to be drawn out from apparatus main body A through support rails 82L and 82R.

Box element 8 is constituted of image forming portions 10Y, 10M, 10C and 10K, and endless belt-form intermediate transfer member 7.

Image forming portions 10Y, 10M, 10C and 10K are vertically arranged in a column. Endless belt-form intermediate transfer member 7 is arranged at the illustrated left side of photoreceptors 1Y, 1M, 1C and 1K. Endless belt-form transfer member unit 7 is constituted of endless belt-form transfer element 70 which is rotatable winding around rollers 71, 72, 73 and 74; primary transfer rollers 5Y, 5M, 5C and 5K; and cleaning means 6A.

Figure 2:
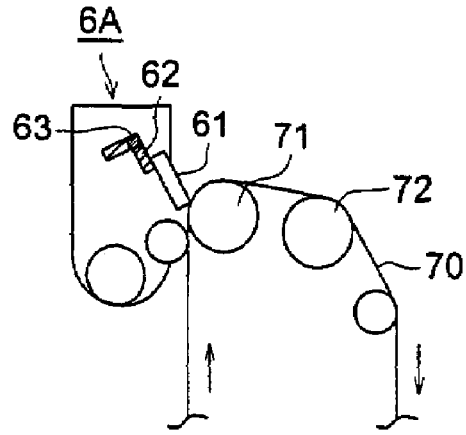
FIG. 2 shows an example of a cleaning means for an intermediate transfer member.

FIG. 2 shows an example of a cleaning means for an intermediate transfer member. A cleaning means for an intermediate transfer member is constituted of blade 61 attached to blanket 62 which is controlled so as to be rotatable around support shaft 63 as shown in FIG. 2, and is possible to adjust the blade pressing pressure against roller 71 by changing spring weight or loading weight.

Image forming portions 10Y, 10M, 10 C and 10K, together with endless belt-form intermediate transfer member 7, are drew out as one unit, from main body A by a drawing out operation of box element 8.

Support rail 82L on the illustrated left side of box element 8 is arranged on the left side of endless belt-form intermediate transfer member 70 and in the upper space portion of fixing means 24. Support rail 82R on the illustrated right side of box element 8 is arranged in the neighboring of under lowermost development means 4K. Support rail 82R is arranged at a position where the mounting and dismounting operations of development means 4Y, 4M, 4C and 4K on and from box element 8 is not interfered.

Photoreceptors 1Y, 1M, 1C and 1K in box element 8 are surrounded by development means 4Y, 4M, 4C and 4K at the illustrated right side, by such as electric charging means 2Y, 2M, 2C and 2K and cleaning means 6Y, 6M, 6C and 6K at the illustrated lower side, and by endless belt-form intermediate transfer member 70 at the illustrated left side.

Among them, such as a photoreceptor, a cleaning means and an electric charging means constitute one photoreceptor unit, and such as a development means and a toner supply device constitute one development unit.

Figure 3:
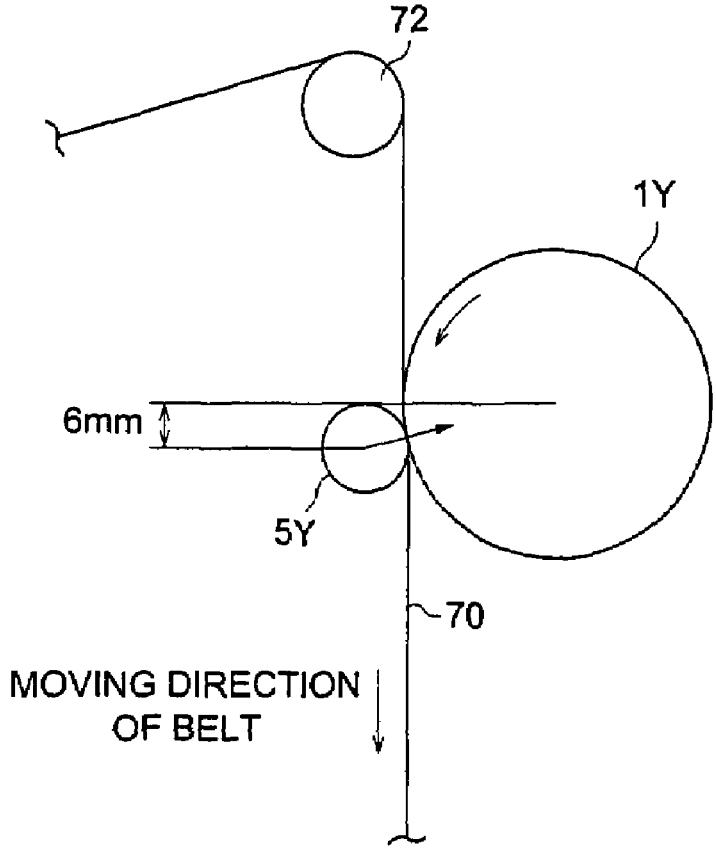
FIG. 3 is an arrangement drawing to show an example of positional relation of a photoreceptor, an endless belt-form intermediate transfer member and a primary transfer roller.

FIG. 3 is an arrangement drawing showing a positional relationship of a photoreceptor, an endless belt-form intermediate transfer member and a primary transfer roller. Primary transfer rollers 5Y, 5M, 5C and 5K are pressed from behind endless belt-form intermediate transfer member 70 as an intermediate transfer member against each photoreceptor 1Y, 1M, 1C and 1K; and primary transfer rollers 5Y, 5M, 5C and 5K are arranged more down-stream, in a rotating direction of a photoreceptor, than the contact point of endless belt-form intermediate transfer member 70 with each photoreceptor 1Y, 1M, 1C and 1K, when they are not in a state of being pressed, and pressed against each photoreceptor 1Y, 1M, 1C and 1K; as is shown in FIG. 3. At this time, in the constitution, endless belt-form transfer element 70 as an intermediate transfer member is bent so as to follow the outer circumference of each photoreceptor 1Y, 1M, 1C and 1K, and primary transfer rollers 5Y, 5M, 5C and 5K are arranged at most down-stream in the contact range of a photoreceptor with endless belt-form intermediate transfer member 70.

Figure 4:
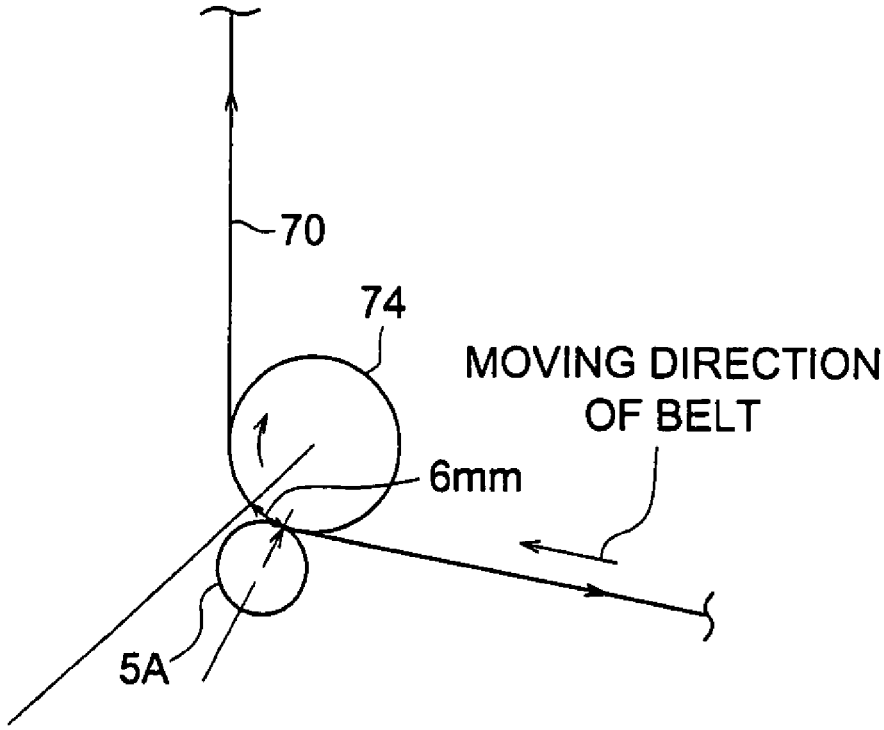
FIG. 4 is an arrangement drawing to show positional relation of a back-up roller, an endless belt-form intermediate transfer member and a secondary transfer roller.

FIG. 4 is an arrangement drawing showing a positional relationship of a back-up roller, an endless belt-form transfer element and a secondary transfer roller. Secondary transfer roller 5A is preferably arranged, as is shown in FIG. 4, at upper-stream in a rotating direction of back-up roller 74, than the center of a contact portion of endless belt-form intermediate transfer member 70 as an intermediate transfer member, with back-up roller 74, when they are not in a state of being pressed by secondary transfer roller 5A.

As an intermediate transfer member, utilized are polymer films such as polyimide, polycarbonate and PVdF, synthetic rubbers such as silicone rubber and fluorine-contained rubber, which having been made electric conductive by adding an electric conductive filler such as carbon black; either a drum-form or a belt-form is applicable, however, a belt-form is preferable with respect to latitude in apparatus design.

It is preferable that a ten-point surface roughness of an intermediate transfer member Rz is 0.4-2.0 μm. By setting a surface roughness Rz of an intermediate transfer member in this range, the surface pressure at an interface between a photoreceptor and an intermediate transfer member tends to be uniform, as well as image defects such as uneven transfer, hollow characters and scattering of characters are hardly generated. Further, by setting a surface roughness Rz of an intermediate transfer member in this range, toner adhesion strength on an intermediate transfer member is decreased to make improvement of a transfer ratio of secondary toner transfer from an intermediate transfer member to a recording sheet easier. A transfer ratio of secondary toner transfer from an intermediate transfer member to a recording sheet is liable to decrease when a surface roughness of an intermediate transfer member Rz is less than 0.4 μm, while roughness of the surface of an intermediate transfer member becomes too large and image defects such as hollow characters in an image on a recording sheet easily generate when a surface roughness of an intermediate transfer member Rz is over 2.0 μm.

Ten-point Average Surface Roughness Rz:

A surface roughness of an intermediate transfer member Rz is represented by a difference-between a mean height of five peaks from the highest peak and a mean depth of five bottoms from the lowest bottom in the standard length of 2.5 mm.

As a measuring device, utilized was a surface roughness meter (Surfcorder SE-30H, produced by Kosaka Laboratory). Herein, other meters may be utilized, provided that they generate the same result within an error range.

Measurement Condition of Surface Roughness Rz

A measurement speed (Drive speed: 0.1 mm/sec); a measurement stylus diameter (Stylus: 2 μm)

Rz of an intermediate transfer member is 0.4-2.0 μm and preferably 0.5-1.8 μm.

A method to roughen the surface of an intermediate transfer member includes such as a method in which micro-particles of approximately 0.2-10 μm or electric conductive filler is added in a polymer film or a synthetic rubber, and a sand blast processing method in which micro-particles are collided on to the support surface. However, a method to roughen the surface of an intermediate transfer member is not limited thereto.

A surface pressure of an intermediate transfer member (against an organic photoreceptor) at the time of primary transfer of toner from an organic photoreceptor to an intermediate transfer member is preferably 0.1-0.5 g/cm$^2$. Transfer of toner is liable to be insufficient when it is less than 0.1 g/cm$^2$ while the surface of a photoreceptor or of an intermediate transfer medium are liable to be damaged when it is over 0.5 g/cm$^2$, resulting in easy generation of image defects such as uneven transfer and hollow characters.

It is preferable that image forming is performed by the image forming apparatus having an agent applying means in which a surface energy-lowering agent is supplied on the surface of a photoreceptor. An agent applying means can be installed at a suitable position in the neighborhood of a photoreceptor, and may be installed utilizing a part of a charging means, developing means or cleaning means which are illustrated in FIG. 1 to effectively make the most of install space. An example will be described below in which an agent applying means is combined with a cleaning means.

Figure 5:
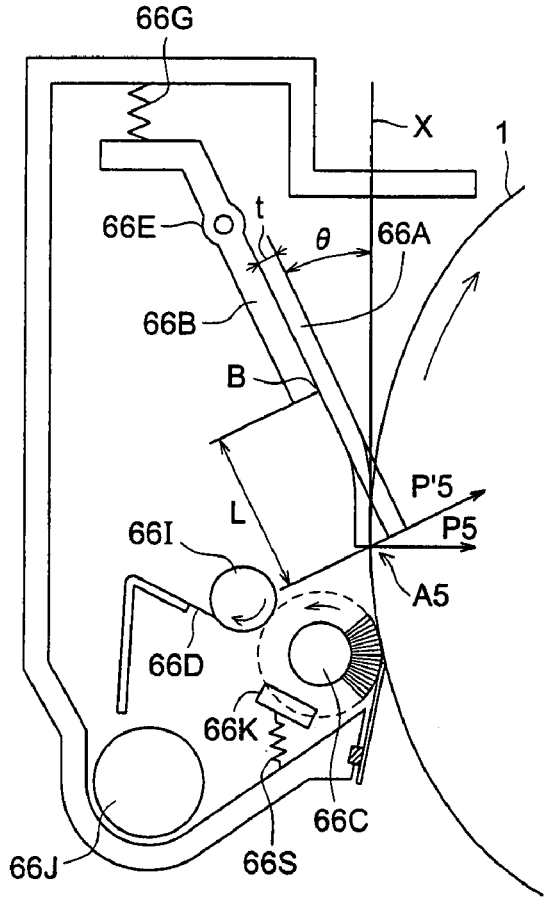
FIG. 5 is a drawing to show an example of a constitution of a cleaning means installed at a photoreceptor.

FIG. 5 is a constitutional drawing of a cleaning means mounted on a photoreceptor of the invention. The cleaning means is utilized as a cleaning means of such as 6Y, 6M, 6C and 6K in FIG. 1. Cleaning blade 66A of FIG. 5 is attached to holder 66B. As a material for the cleaning blade, utilized are rubber elastomers, such as urethane rubber, silicone rubber, fluorine-contained rubber, chloroprene rubber and butadiene rubber which are well known, and among them specifically preferable is urethane rubber with respect to an excellent abrasion-resistance compared to other rubbers.

A rebound elasticity of a cleaning blade is preferably in a range of 40-75. Cracks may often be generated on the surface of a photoreceptor when the rebound elasticity is over 75. While, the blade is liable to be damaged resulting in deterioration of the cleaning capability when the rebound elasticity is less than 40. Herein, a rebound elasticity is an index to represent a rebound coefficient of bounding back a colliding or dropping object, and it is specifically measured based on a physical test method of vulcanized rubber in JISK6301. A value of rebound elasticity is represented based on %.

On the other hand, holder 66B is constituted of a metal material or plastic material of a plate-form. Metal materials preferably include a stainless steel plate, an aluminum plate or an anti-vibration steel plate.

The top edge portion of a cleaning blade which pressing contacts to the photoreceptor surface is preferably pressing contacts in a state of loading a weight toward the opposite direction (counter direction) to the rotational direction of a photoreceptor. As shown in FIG. 5, the top edge portion of a cleaning blade preferably forms a press contact plane when being pressing contacted to a photoreceptor.

Press contact weight P5 and contact angle θ of a cleaning blade against a photoreceptor are preferably as follows: P5 is from 5 to 40 N/m and θ is from 5 to 35 degrees.

Press contact weight P5 is a vector value in the perpendicular direction of press power P'5 when cleaning blade 66A is in pressing contact with photoreceptor 1.

Further, press contact angle θ represents an angle between a tangent X and a blade before being deformed, at contact point A of a photoreceptor. 66E represents a rotation axis which makes a holder rotatable, and 66G represents a load spring.

Further, free length L of the above-described cleaning blade represents, as shown in FIG. 5, a length from the edge B of holder 66B to the top edge of a blade before being deformed. The free length is preferably from 6 to 15 mm, and the thickness of a cleaning blade (t) is preferably from 0.5 to 10 mm. Wherein, a thickness of a cleaning blade is defined, as shown in FIG. 5, a perpendicular direction to the adhered surface of holder 66B.

In a cleaning means of FIG. 5, utilized is brush roller 66C which serves also as an agent applying means. The brush roller provided with a function as an applying means which supplies a surface energy-lowering agent on a photoreceptor together with functions to remove a toner adhered on a photoreceptor and to recover a toner removed by cleaning blade 66A. That is, the brush roller contacts with photoreceptor 1 and rotates in the same direction as the progressing direction of a photoreceptor at the contact portion; thereby, it removes a toner or paper dust on a photoreceptor, as well as conveys the toner removed by cleaning blade 66A to be recovered into convey screw 66J. During the process, it is preferable to remove removed materials such as a toner which have been transferred from a photoreceptor to brush roller 66C by bringing brush roller 66C in pressing contact with flicker 66I as a removing means. Further, a toner adhered to the flicker is removed by scrubber 66D to recover a toner into convey screw 66J. A toner recovered is taken out of an apparatus as waste or reused by being conveyed through a recycle pipe for reuse (not shown in the figure) to a development device. As materials for flicker 66I, preferably used is a metal pipe such as made of stainless steel or aluminum. On the other hand, as scrubber 66D, utilized are elastic plates such as a phosphor bronze plate, a polyethylene terephthalate plate and a polycarbonate plate, and the top edge thereof is preferably brought in pressing contact in a counter-way forming an acute angle against the rotating direction of a flicker.

Further, surface energy-lowering agent 66K (a solid material such as zinc stearate) is attached to a brush roller being pressed by spring load 66S, and as the brush abrades while being rotated, the surface energy-lowering agent is supplied on the surface of a photoreceptor. Although a surface energy-lowering agent is a rectangular solid-shaped in FIG. 5, it may be a circular cylinder-shaped.

A brush roller made of an electric conductive or semi-conductive material is utilized as brush roller 66C.

As a brush constitution material for a brush roller utilized in the invention, arbitrary materials can be used, however, a fiber-forming high polymer which is hydrophobic and has a high dielectric constant is preferably used. Such high polymers include, for example, rayon, nylon, polycarbonate, polyester, methacrylic resin, acrylic resin, polyvinyl chloride, polyvinylidene chloride, polypropylene, polystyrene, polyvinyl acetate, styrene-butadiene copolymer, vinylidene chloride-vinyl acetate copolymer, vinylidene chloride-vinyl acetate-maleic anhydride copolymer, silicone resin, silicone-alkyd resin, phenol formaldehyde resin, styrene-alkyd resin, polyvinyl acetal (e.g., polyvinyl butyral), etc. These binder resins can be utilized alone or in combinations of two or more kinds. Specifically preferable are rayon, nylon, polyester, acrylic resin and polypropylene.

Further, as the brush described above, conductive or semi-conductive one is utilized, and can be utilized one having an arbitrarily adjusted specific resistance by including a substance having a low resistance such as carbon as a constituent material.

The specific resistance of a brush hair of a brush roller is preferably in a range of from $10^1$ Ωcm-$10^6$ Ωcm, when it is measured under ordinary temperature and humidity (a temperature of 26 degree C. and a relative humidity of 50%) in a state of an electric voltage of 500 V being applied on the both ends of a brush hair of 10 cm long.

That is, a brush roller is preferably made of a core material such as stainless steel with conductive or semi-conductive brush hair having a specific resistance of $10^1$ Ωcm-$10^6$ Ωcm. In case of a specific resistance of lower than $10^1$ Ωcm, it is liable to produce such as banding due to discharge; while, in case of higher than $10^6$ Ωcm, it is liable to cause poor cleaning due to a reduced potential difference from a photoreceptor.

The thickness of a brush hair utilized for a brush roller is preferably from 5 to 20 deniers. When it is less than 5 deniers, surface adhered substances unable to be removed due to insufficient abrasion pressure. When it is not less than 20 deniers, a brush becomes rigid to hurt the surface of a photoreceptor as well as to cause abrasion to proceed, resulting in a shortened life of a photoreceptor.

Herein, "denier" is a measured value based on a weight in a gram unit of a 9000 m long brush hair (fiber) constituting the above-described brush.

The density of brush hairs of the brush described above is from $4.5\times10^2/cm^2$-$2.0\times10^4/cm^2$ (number of brush hairs per one square centimeter). When it is less than $4.5\times10^2/cm^2$, not only rigidity is low and abrasion pressure is weak but also uneven abrasion is caused, which makes uniform removal of adhered substances impossible. When it is not less than $2.0\times10^4/cm^2$, a brush becomes rigid to increase abrasion pressure which abrade a photoreceptor, resulting in generation of image defects such as fog due to reduced sensitivity and black streaks due to abrasion marks.

The intrusion amount of a brush roller into a photoreceptor is preferably adjusted to from 0.4 to 1.5 mm, and more preferably to from 0.5 to 1.2 mm. This intrusion amount means a load, which is generated by relative movement of a photoreceptor and a brush roller and is applied on a brush. From a standpoint of a photoreceptor drum, the load corresponds to abrasion pressure received from a brush, and to regulate the pressure range means that a photoreceptor is necessarily being abraded with appropriate pressure.

The intrusion amount represents an intruding length assuming that brush hairs penetrated linearly into the body without bending at the surface of a photoreceptor when a brush is brought in pressing contact with a photoreceptor.

Since abrasion pressure by a brush at the surface of a photoreceptor is low with a photoreceptor being supplied with a surface energy-lowering agent, it is unable to depress filming of a toner or paper dust on the surface of a photoreceptor when an intrusion amount is less than 0.4 mm, resulting in generation of defects such as unevenness of an image. On the other hand, when it is more than 1.5 mm, abrasion amount of a photoreceptor becomes large due to an excess abrasion pressure on the surface of a photoreceptor by a brush, which is problematic because there caused fogging due to a decreased sensitivity or streak defect on an image due to generation of abrasion marks on the surface of a photoreceptor.

As a roll core material for a brush roll used in the invention, mainly utilized are metals such as stainless steel and aluminum; paper, plastic, etc.

A brush roll is preferably constituted by setting a brush on the surface of a cylindrical core material via an adhesive layer.

A brush roll preferably rotates so that the pressing contact portion moves in the same direction as the surface of a photoreceptor. In case that the pressing contact portion moves in the opposite direction, a toner removed by a brush roll may be spilled to contaminate a recording material or an apparatus when an excess toner is present on the surface of a photoreceptor.

When a photoreceptor and a brush roll move in a same direction as described above, the ratio of the both surface velocities is preferably a value within a range between 1 to 1.1 and 1 to 2. When a rotation velocity of a brush roll is slower than a photoreceptor, cleaning failure is liable to occur due to a reduced toner removing ability of a brush roll, while when it is too much faster than a photoreceptor, blade bounding or turn over is liable to occur due to an excess toner removing ability.

Wherein, a surface energy-lowering agent refers to a material which adheres to the surface of a photoreceptor and lowers a surface energy, and specifically a material which increases a contact angle (a contact angle against pure water) of the surface of a photoreceptor by not less than 1 degree by adhering on the surface.

Measurement of Surface Contact Angle

A contact angle of a photoreceptor surface is measured against pure water by use of a contact angle meter (CA-DT•A type: produced by Kyowa Interface Science Co., Ltd.) under environment of 30 degree C. and 80% RH. Before measuring the contact angle, the photoreceptor must be kept under the environment of 30 degree C. and 80% RH for 10 hours.

A variation of contact angle is measured under environment of 30 degree C. and 80% RH. The measurement is performed when a photoreceptor is accustomed to image formation and a surface energy-lowering agent is sufficiently applied on the surface of a photoreceptor (for example, after image formation of 1000 sheets). The measurement was performed at a total of 12 points: 4 points of every 90 degree in a circumferential direction in each of 3 portions, at the center portion and at the portions 5 cm from the left and right edges of a cylindrical photoreceptor; an average value thereof was defined as a contact angle of the invention and a variation was determined from values most distant in plus and minus.

Further, in the invention, the variation of a contact angle of a photoreceptor described above is preferably within ±5 degree, more preferably within ±4 degree and most preferably within ±3 degree. When a variation of a contact angle is over a range of ±5 degree, it is liable to cause halftone unevenness as well as to cause such as hollow characters and scattering of characters.

According to the invention, a contact angle is increased by applying a surface energy-lowering agent on the surface of a photoreceptor, and the contact angle is preferably in a range of from 90 to 120 degree. When it is less than 90 degree, effect to prevent hollow characters and scattering of characters is small; when it is not less than 120 degree, disadvantages other than a variation of a contact angle are liable to become significant. That is, suitable materials are hardly found as a surface energy-lowering agent which makes a contact angle not less than 120 degree, and an electrophotographic image is liable to suffer from deterioration by adding such a material to a photoreceptor.

A surface energy-lowering agent includes a metal salt of fatty acid or a fluorine-contained resin, and these materials are liable to have large water content under conditions of high temperature and high humidity due to hydrophilic groups or impurity components in the materials. When the water content becomes large, the effects of the invention described above are hardly exhibited sufficiently because the surface energy-lowering agent is not uniformly plated on the surface of a photoreceptor. A surface energy-lowering agent utilized in the invention is able to exhibit the effects of the invention sufficiently, by having a water content of not more than 5 weight % under conditions of high temperature and high humidity of 30 degree C. and 80% RH.

Further, a surface energy-lowering agent is not limited to materials such as a metal salt of fatty acid or a fluoride-contained resin provided that a material increases a contact angle (a contact angle against pure water) of the surface of a photoreceptor by not less than 1 degree.

A surface energy-lowering agent utilized in the invention is preferably a metal salt of fatty acid as a material which has a spreading property and a film forming ability on the surface of a photoreceptor. A metal salt of fatty acid is preferably a metal salt of saturated or unsaturated fatty acid having not less than 10 carbon atoms. For example, such as aluminum stearate, indium stearate, gallium stearate, zinc stearate, lithium stearate, magnesium stearate, sodium stearate, aluminum palmitate and aluminum oleate are listed, and more preferable is a metal salt of stearic acid.

Among the metal salts of fatty acid described above, particularly a metal salt of fatty acid having a high effusion velocity of a flow tester is able to form a layer of a metal salt of fatty acid more effectively on the foregoing surface of the photoreceptor of the invention because of its high cleavage property. A range of an effusion velocity is preferably not less than $1\times10^{-7}$ and not more than $1\times10^{-1}$ and most preferably not less than $5\times10^{-4}$ and not more than $1\times10^{-2}$. An effusion velocity of a flow tester is measured by use of Shimadzu Flow Tester CFT-500 (produced by Shimadzu Corp.).

Further, as other examples of the solid material described above preferable are fluorine-contained resin powder such as polyvinylidene fluoride and polytetrafluoroethylene. These solid materials are preferably utilized by being made into a plate-shape or a bar-shape by applying pressure when necessary.

Herein, measurement of a water content is performed, in case of a surface energy-lowering agent, by charging the material in a shallow glass vessel and after being kept at 30 degree C. and 80% RH for 24 hours, by use of Karl Fischer's water content meter (produced by Kyoto Electronics Manufacturing Co., Ltd.; MKA-3p).

A method to make a water content of a surface energy-lowering agent not more than 5 weight % is achieved by decrease of a water content under a condition of high temperature and high humidity (30 degree C. and 80% RH) which is made possible by controlling hydrophilic components or impurities in the material, for example, by purification or hydrophobicity treatment; as well as by mixing of a water content controlling agent; or by high temperature drying treatment at not lower than 100 degree C. The water content described above is preferably from 0.01 to 5.0 weight % and more preferably from 0.05 to 3.0 weight %, to minimize dependence on environmental variation such as temperature rise during copying, particularly dependence on humidity of a set up place of an image carrying element, to make selection of materials and hydrophobicity treatment easy, and to prevent hollow characters and scattering of characters.

Organic photoreceptor is explained below.

Cylindricity is based on JIS (B0621-1984). Or when a cylindrical substrate is sandwiched between two coaxial geometrical cylinders, cylindricity is represented by difference between the radii of the two cylinders disposed at the position where an interval between the two cylinders is minimized. The difference between the radii is expressed in terms of μm here.

A cylindricity of a cylindrical organic photoreceptor (hereinafter, also referred to as a photoreceptor) is 5-40 μm, preferably 7-30 μm and more preferably 7-27 μm. When it is over 40 μm, a surface pressure at a contact interface between a photoreceptor and an intermediate transfer member is liable to become uneven resulting in easy generation of image defects such as uneven transfer, hollow characters and scattering of characters. Herein, the aforesaid cylindricity of an organic photoreceptor means a cylindricity of the region in which image formation is essentially performed and eliminated is a layer thickness varying region of the both edges in which image formation is not performed.

The cylindricity is determined by measuring the roundness at each of the seven positions including a midpoint, two positions spaced a distance of 10 mm from opposite ends, and four intermediate positions determined by dividing a distance between the midpoint and each end into 3 divisions, using a non-contact universal roll diameter measuring device (available from Mitsutoyo Co., Ltd.).

In-low process explained below means a process to cutting process the inside of an cylindrical substrate and to form a processed plane such as steps (for such as attaching a part material) on the inside surface of the substrate, and a cylindrical substrate is processed while being rotated by being attached with a cutting bite and transferred.

Since in-low process explained below is primarily intended to form steps, on which a flange is attached, on the both edges of a cylindrical substrate, steps having a length of d mm in the substrate axis direction (in-low length) are provided on the both edges of a cylindrical substrate. In this invention, a length of a holder D is preferably in the range described below, when a length (in the axis direction) of cylindrical substrate is L mm and a length (in the axis direction) of a holder is D mm.

$$\frac{1}{2}\times L \leqq D \leqq L-2d$$

When D is smaller than ½×L, the both edges of a substrate is liable to spin like a top resulting in deterioration of process precision. While D is larger than L−2d, space for in-low process is not sufficient resulting in difficulty of the processing operation.

A holder explained below refers to a member which is inserted to be brought into press contact against the inside diameter of a cylindrical substrate to depress vibration and prevent a shape deformation of the substrate at the time of processing of a cylindrical substrate such as in-low processing.

The outside diameter standard explained below refers to setting the center axis of the outer surface cylinder to be a standard axis.

The inside diameter standard of an in-low processed portion explained below refers to setting the center axis of the inner diameter of a cylinder formed by the in-low processing to be a standard axis.

In the following, a photoreceptor will be detailed referring to drawings.

Figure 6:
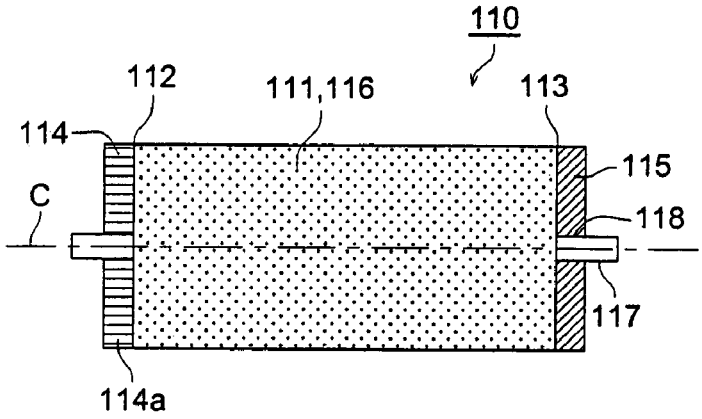
FIG. 6 shows a schematic front view of electrophotographic photoreceptor according to an embodiment of the present invention.

FIG. 6 is a schematic front view drawing of organic photoreceptor 110 utilized in this invention, the photoreceptor being constituted of cylindrical substrate 111 and flanges 114 and 115 provided at edges 112 and 113, which are the both side openings, and photosensitive layer 116 is formed on the surface of cylindrical substrate 111. Further, shaft 117 is arranged at the center of organic photoreceptor 110 so as to coincide with axis C of cylindrical substrate 111, and enables organic photoreceptor 110 to rotate.

The cylindrical substrate 111 to be used is formed by conductive metal such as Al and aluminum alloys, and is processed to be hollow cylinder-shaped. For example in case of using aluminum alloys, it is made cylindrical by process of drawing and/or cutting.

The flanges 114 and 115 are disk-like to be fitted to the inner surface of the cylindrical substrate 111 to make the cylindrical substrate columnar, and holes 118 are formed in the center thereof. Additionally a toothed gear 114*a* is formed on the periphery of the flange 114, and thereby rotation of the photoreceptor 110 is controllable.

The shaft 117 is a rod-shaped member by use of metal, plastic or the like whose cross section is rectangular like a foursquare or the like, cruciate, circular or the like. Material with less distortion such as curvature is used. The shaft 117 is fixed through the holes 118 formed in the flanges 114 and 115. As a result, the shaft 117 is a shaft for supporting rotation of the electrophotographic photoreceptor 110.

The photosensitive layer 116 comprises photoconductive material having the photoelectric effect, such as an organic photoconductor (OPC) photosensitive layer.

To prepare an organic photoreceptor, firstly the cylindricity of aforesaid cylindrical substrate 111 is processed to be 5-40 μm.

FIGS. 7(*a*) and 7(*b*) show a production process of cylindrical substrate of the present embodiment in the order of processes of FIG. 7(*a*) and FIG. 7(*b*). First, a cylindrical substrate 111 having a hollow cylindrical shape shown in FIG. 7(*a*) is prepared. Aluminum alloy formed into wall thickness of 2 mm and an outside diameter of 100 mmΦ by drawing may be used as the cylindrical substrate 111.

FIG. 7(*a*) is an illustration showing a supporting member 103 is inserted into the interior of the substrate and processed with a cutting tool as "in low process". The edge portions are treated with "in low process" so as to provide a step thereon. In these portions, thin-walled portions (socket portions) 112*a* and 113*a* having thicknesses decreased and inside diameters enlarged by one thickness of the step are formed although the outside diameter is not changed.

In the "in low process", the interior of the cylindrical substrate is gripped by a supporting member and a pressure variator 104. The cylindrical substrate is rotated around a central shaft 119 penetrating the supporting member by motors 120 and 121. A turning cutter 122 is attached to the interior of the substrate, and the substrate is treated with the "in low process". That is, the surface of the cylindrical substrate is prevented from being scratched by gripping the interior of the cylindrical substrate.

Next, utilizing said in-low processed cylindrical substrate, there is performed a cutting processing of the surface thereof. That is, FIG. 7(*b*) is a drawing to show cutting process of the substrate surface based on the inner diameter standard of in-low processed portions, while in-low portions of the both edges of cylindrical substrate, having an inside diameter formed by the aforesaid in-low process, are gripped by use of grip hook 123 opening and closing of which are operated by slide opening and closing chucks (AIR-BALLOON CHUCK, CRAFTGRAPHY, produced by Dynamic Tool Co., Ltd. 124 and 125.

By utilizing the above-described processing method of a cylindrical substrate, a substrate for an organic photoreceptor having an outer diameter cylindricity of 5-40 μm can be prepared. 126 is a cutter blade.

The aforesaid holder is preferably made of rigid material having a large strength to restrain vibration at the time of in-low processing and maintain the shape. As said rigid material, preferable are metals such as stainless steel and brass ceramics. Further, said holder may be equipped with a contact pressure variator. In the following, explained will be a method of inserting and pressing said rigid material into the inner diameter of a cylindrical substrate.

FIG. 8(*a*) is an oblique view drawing of holder 113. FIG. 8(*b*) is a sectional drawing to show pressure variator 104 of the holder. Each of 103-1 -103-8 is a part of holder having a semi-circular section, wherein each part is bonded with a loose connection, for example, with a spring to constitute the whole holder, and an outer surface of the holder forms a cylindrical shape so as to contact to the cylindrical substrate inner surface. The center portion of the holder forms a ring so that center bar 104-1 having a taper can be inserted and extracted as a pressure variator as illustrated in FIG. 8(*b*). By inserting center bar 104-1 as shown in FIG. 8(*b*), holder expands toward outside to hold a substrate while pressing. The pressure at the time of pressing is controlled by an insert depth of center bar 104-1.

As a support material, elastic materials such as hard urethane and rubber can be also utilized instead of the above-described rigid materials.

Further, above-described center bar 104-1 is provided with center axis 119 passing through the support material, and in-low processing is performed by rotationally driving a cylindrical substrate around this center axis.

Figure 9:
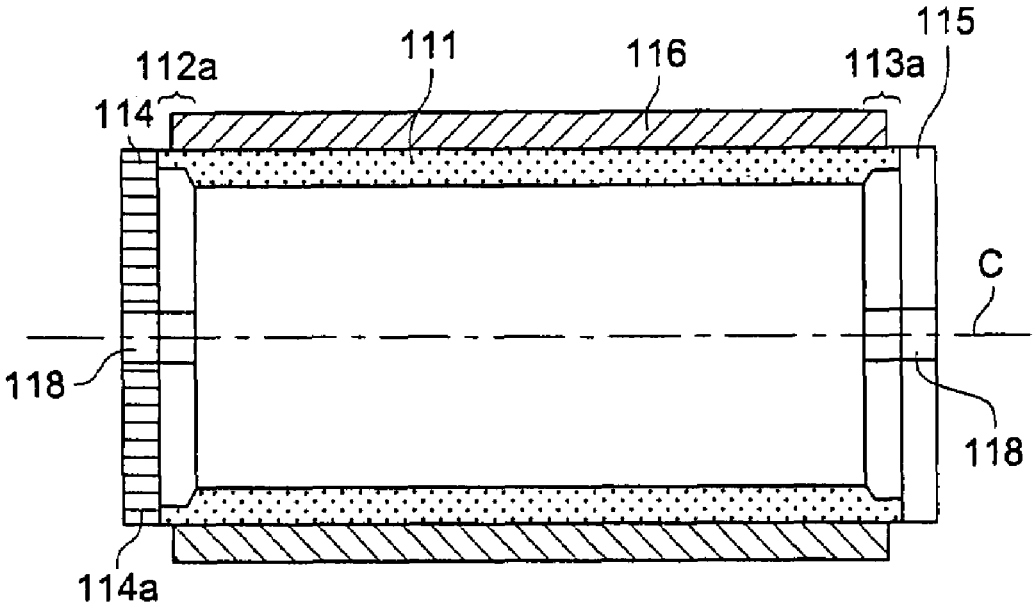
FIG. 9 is an illustration showing a photosensitive layer is formed by coating on the exterior surface of the cylindrical conductive substrate.

Next, after the substrate is washed, photosensitive layer 116 is formed by coating on the outer surface of cylindrical substrate 111 as illustrated in FIG. 9.

Next, flanges 114 and 115 are fixed to the cylindrical substrate on which a photosensitive layer having been formed. Flanges 114 and 115 are disc shaped comprising an outer part, having an approximately equal outer diameter to that of cylindrical substrate 111, which is attached to cylindrical substrate 111 to make a lid, and an inner part having an outer diameter smaller than that of an outer part, and provided with hole 118 at the center. The inner part having a smaller outer diameter has an outer diameter equal to or slightly larger than the inner diameter of thin layer portions 112*a* and 113*a*. The inner parts having a smaller outer diameter of flanges 114 and 115 lock into the thinner layer portions of cylindrical substrate 111. Thus, flanges 114 and 115 are fixed at the edges of cylindrical substrate 111 so as to cover the cylinder edges. At this time, a cylindricity, based on axis C being the center, of cylindrical substrate 111 is preferably 5-40 pm, in a state of being equipped with flanges 114 and 115. Herein, gear 114*a* is formed at the circumference portion of one flange 114. Further, holes 118 are provided at the center portion of the flanges to fix a shaft.

Description will be next made of the constitution of the organic photoreceptor.

The organic photoreceptor as used herein is intended to refer to a photoreceptor using an organic compound given at least one of charge transport function and charge generation function. The organic photoreceptor includes any customarily employed organic photoreceptor using an organic charge transport material or an organic charge generation material, or using a polymeric complex material having both charge transport and generation functions.

Although the layer structure of the organic photoreceptor is not limited, the photosensitive layer may be preferably a laminate of a charge generating layer and a charge transporting layer or a single layer having both charge transport and generation functions. A protecting layer may be preferably provided over the photosensitive layer.

<Cylindrical Substrate>

A drum of metal such as aluminum or nickel may be suitably used as the cylindrical substrate. The specific electric resistively of the cylindrical substrate is preferably not more than $10^3$ Ωcm at room temperature.

<Interlayer>

An interlayer having a barrier function may be interposed between the electrically conductive substrate and the photosensitive layer. The interlayer (including an undercoat layer) may be also formed for the purpose of improving the adhesion between the electrically conductive substrate and the photosensitive layer or for minimizing charge injection from the substrate. Examples of the material of the interlayer include polyamide resins, vinyl chloride resins, vinyl acetate resins, and copolymer resins comprising at least two repeating units of these resins. Of these subbing resins, polyamide resins are preferable as the resins which are capable of minimizing an increase in residual potential accompanied under repeated use. Further, the thickness of the interlayer comprised of these resins is preferably between 0.01 and 0.5 μm.

It is particularly preferred that the interlayer be comprised of a hardenable metal resin obtainable by thermally hardening an organic metal compound such as a silane coupling agent or a titanium coupling agent. The thickness of the interlayer comprised of the hardenable metal resin is preferably between 0.1 and 2 μm.

<Photosensitive Layer>

In the structure of a photoreceptor, the photosensitive layer preferably has a layered structure including a charge generating layer (CGL) and a charge transporting layer (CTL), although a single structure photosensitive layer having both of the charge generation function and the charge transport function may be used. An increase of the remaining potential accompanied with repetition of the use can be inhibited and another electrophotographic property can be suitably controlled corresponding to its purpose due to the separation of the functions of the photosensitive layer into the charge generation and the charge transport. In the photoreceptor to be negatively charged, it is preferable that the CGL be provided on a subbing layer and the CTL be further provided on the CGL. In the photoreceptor to be positively charged, the order of the CGL and CTL in the negatively charged photoreceptor may be reversed. The most preferable photosensitive layer structure is the structure of the photoreceptor to be negatively charged having the function separated structure.

The photosensitive layer of the function separated negatively charged photoreceptor will be described in detail below.

<Charge Generation Layer>

The charge generation layer contains one or more charge generation materials (CGM). Other materials such as a binder resin and additives may be contained if desired.

Any conventional CGM may be suitably used. Examples of usable CGM include a phthalocyanine pigment, an azo pigment, a perylene pigment and an azulenium pigment. Among them, the CGM having a steric and potential structure capable of taking a stable intermolecular aggregated structure can strongly inhibit the increasing of the remaining potential accompanied with the repetition of use. Specifically, examples of such the CGM include a phthalocyanine pigment and a perylene pigment each having a specific crystal structure. For example, a titanylphthalocyanine having the maximum peak of Bragg angle 2θ of Cu-Kα ray at 27.2° and a benzimidazoleperylene having the maximum peak of Bragg angle 2θ of Cu—-Kα ray at 12.4° as the CGM are almost not deteriorated by the repetition of use and the increasing of the remaining potential is small.

A known binder can be used in the charge generation layer as the dispersion medium of the CGM. Examples of the most preferable resin. include a formal resin, a butyral resin, a silicone resin, a silicon-modified butyral resin and a phenoxy resin. The charge generation material is preferably used in an amount of 20 to 600 parts by mass per 100 parts by mass of the binder resin. By the use of such a resin, an increase of the remaining potential accompanied with the repetition of use can be minimized. The thickness of the charge generation layer is preferably from 0.01 μm to 2 μm.

Charge Transport Layer

The charge transport layer contains a charge transport material (CTM) and a layer-formable binder resin in which the CTM is dispersed. An additive such as an antioxidant may be further contained if desired.

Any customarily employed CTM may be used. For example, a triphenylamine derivative, a hydrazone compound, a styryl compound, a benzizine benzyl compound and a butadiene compound may be used as the CTM. These charge transport materials are usually dissolved in a suitable binder resin to form a layer. Among them, the CTM capable of minimizing the increasing of the remaining potential accompanied with repetition of use is one having a high electron mobility, and the difference in the ionization potential between the CTM and the CGM to be used in combination with the CTM is preferably not more than 0.5 (eV), more preferably not more than 0.25 (eV).

The ionization potential of the CGM and CTM is measured by a surface analyzer AC-1 (manufactured by Riken Keiki Co., Ltd.).

Examples of the resin to be used for CTL include a polystyrene, an acryl resin, a methacryl resin, a vinyl chloride resin, a vinyl acetate resin, a poly(vinyl butyral) resin, an epoxy resin, a polyurethane resin, a phenol resin, a polyester resin, an alkyd resin, a polycarbonate resin, a silicone resin, a melamine resin, a copolymer containing two or more kinds of the repeating unit contained in the foregoing resins, and a high molecular weight organic semiconductive material such as poly(N-vinylcarbazole) other than the foregoing insulating resins.

Above all, the polycarbonate resin is most preferable as the binder for CTL. The polycarbonate resin is most preferable since the resin simultaneously improves the dispersing ability of the CTM and the electrophotographic property. The ratio of the binder resin to the charge transport material is preferably from 10 to 200 parts by mass to 100 parts by mass of the binder resin, and the thickness of the charge transport layer is preferably from 10 to 40 μm.

Hydrophobic inorganic micro-particles having a number average primary particle diameter of 10-100 nm are preferably incorporated in the surface layer (for example, in a CTL) of a photoreceptor. A number average particle diameter of hydrophobic inorganic micro-particles is more preferably 10-90 nm and most preferably 10-50 nm. By incorporating such inorganic micro-particles in the surface layer, the aforesaid surface energy lowering agent can be uniformly spread on the photoreceptor surface resulting in prevention of image deterioration such as uneven transfer, hollow characters and scattering of characters.

As inorganic micro-particles having a diameter of 10-100 nm, micro-particles of such as silica, zinc oxide, tin oxide, antimony oxide, indium oxide, bismuth oxide, indium oxide doped with tin, tin oxide doped with antimony or tantalum, and zirconium oxide, however, among them, silica, particularly, hydrophobic silica the surface of which is made to be hydrophobic is preferable with respect to a cost and easiness of particle diameter control and surface treatment.

A number average primary particle diameter of inorganic particles is determined by observing randomly selected 300 particles as primary particles through a transparent type electronmicroscope at a magnification of 10000 times and by calculating a measured value as a number average diameter of a ferret diameter by means of image analysis.

The hydrophobicity of the aforesaid hydrophobic silica is preferably not less than 50% based on hydrophobicity represented by a wettability scale against methanol (methanol wettability). When the hydrophobicity is less than 50%, the aforesaid endothermic energy variation AH is liable to be larger than 10 J/g resulting in easy generation of environmental memory, as well as easy damaging of a blade to cause insufficient cleaning. The hydrophobicity is more preferably not less than 65% and most preferably not less than 70%.

A methanol wettability representing hydrophobicity evaluates wettability of silica micro powder against methanol. Wettability measurement is performed as follows. Silica micro powder to be measured of 0.2 g is added into 50 ml of distilled water being charged in a beaker having a volume capacity of 250 ml and stirred. Next, methanol is slowly added drop-wise while stirring from a bullet the top edge of which is immersed in the liquid, until the whole silica micro powder becomes wet. Hydrophobicity is calculated according to following equation (1) when the amount of methanol required to make the silica micro powder completely wet is a (ml).

$$\text{Hydrophobicity}=a/(a+50)\times 100 \qquad \text{Equation (1)}$$

Hydrophobic silica described above is obtained by subjecting silica powder, which is prepared by a commonly known wet method or dry method, to hydrophobicity providing process. In particular, one comprising so-called hummed silica prepared by a dry method (vapor phase oxidation of a silicone halogenide compound) being treated with a hydrophobicity providing agent is preferable with respect to having fewer water absorbing sites. This is manufactured according to a commonly known method. For example, a thermal decomposition oxidation reaction of a silicon tetrachloride gas in oxyhydrogen flame is utilized, and the basic reaction scheme is as follows.

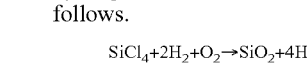

$$SiCl_4+2H_2+O_2 \rightarrow SiO_2+4HCl$$

Further, in this manufacturing process, complex micro powder of silica and another metal oxide also can be obtained, for example, by utilizing another metal halogenide compound such as aluminum chloride or titanium chloride together with a silicon halogenide compound.

A hydrophobic treatment of silica powder can be performed by commonly known conventional methods such as a dry method in which a solution dissolving a hydrophobicity providing agent in such as alcohol is sprayed, or a vaporized hydrophobicity providing agent is contacted to be adhered, or a wet method in which silica powder is dispersed in a solution in which a hydrophobicity providing agent is added dropwise to be adhered.

As a hydrophobic providing agent, commonly known compounds can be utilized, and specifically the followings are included. Further these compounds may be utilized in combination.

Titanium coupling agents include such as tetrabutyl titanate, tetraoctyl titanate, isopropyl triisostearoyl titanate, isopropyl tridecylbenzenesulfony titanate and bis(dioctylpyrophosphate)oxyacetate titanate.

Silane coupling agents include such as γ-(2-aminoethyl) aminopropyl trimethoxysilane, γ-(2-aminoethyl)aminopropyl methyldimethoxysilane, γ-methacryloxypropyl trimethoxysilane, N-β-vinylbenzylaminoethyl-N-γ-aminopropyl trimethoxysilane hydrochloric acid salt, hexamethyldisilazane, methyl trimethoxysilane, butyl trimethoxysilane, isobutyl trimethoxysilane, hexyl trimethoxysilane, octyl trimethoxysilane, decyl trimethoxysilane, dodecyl trimethoxysilane, phenyl trimethoxysilane, o-methylphenyl trimethoxysilane and p-methylphenyl trimethoxysilane.

Silicone oils include such as a dimethyl silicone oil, a methylphenyl silicone oil and an amino-modified silicone oil.

These hydrophobicity providing agents are preferably added to coat silica powder at 1-40 weight % and more preferably at 3-30 weight % based on silica powder.

Further, as the above-described hydrophobicity providing agent, a hydrogen polysiloxane compound can be utilized. Said hydrogen polysiloxane compounds having a molecular weight of 1000-20000 are easily available in general and excellent in prevention function against black spot generation.

The aforesaid hydrophobic silica having been hydrophobicity processed is incorporated together with a binder in the surface layer of an organic photoreceptor, and a ratio of silica particles utilized is 1-20 weight %, preferably 2-15 weight % and most preferably 2-10 weight %, based on the binder.

A coating method such as an immersion coating, a spray coating and coating by a coating amount controlling circular coating means may be used for preparing the photoreceptor. Especially, the coating by the coating amount controlling circular coating method is preferably used so as to inhibit dissolution of the under layer as small as possible and to attain uniform coating. Accordingly, an electrophotographic photoreceptor having a cylindrical substrate with the roundness is maintained. The coating amount controlling circular coating means is described in JP-Tokukaisho-58-189061A.

Description will be next made of the toner. The toner is preferably in the form of mono-dispersed or nearly mono-dispersed particles. The ratio (Dv50/Dp50) of a 50% volume particle diameter (Dv50; median diameter in volume distribution standard) to a 50% number particle diameter (Dp50 median diameter in number distribution standard) is 1.0 to 1.15, preferably 1.0 to 1.13. When the ratio of Dv50/Dp50 exceeds 1.15, the particle diameter distribution is wide.

It is required that the ratio (Dv75/Dp75) of a cumulative 75% volume particle diameter from the largest particle diameter of the toner particle (Dv75) to a cumulative 75% number particle diameter from the largest particle diameter of the toner (Dp75) is 1.1 to 1.20. When the ratio of Dv75/Dp75 exceeds 1.20, small particle diameter components exist in so large an amount that there are caused an increase of weakly charged components, formation of inversely charged toners and formation of excessively charged components.

As a consequence, the transferring efficiency of the toner from the photoreceptor to the intermediate image bearing member will be deteriorated to cause image defects such as unevenness of a transfer and hollow characters.

The toner particles having a particle diameter of 0.7×Dp50 or less accounts for 10% by number or less of a total number of the toner particles are further required.

When the amount of the toner particles having a particle diameter of 0.7×Dp50 or less is greater than 10% by number, small particle diameter components exist in so large an amount that there are caused an increase of weakly charged components, formation of inversely charged toners and formation of excessively charged components. As a result, toner transfer from a photoreceptor to an intermediate transfer member becomes insufficient so that image defects such as uneven transfer and hollow characters are often generated.

Since an electrostatic latent image formed on a cylindrical electrophotographic photoreceptor having a cylindricity of 5 to 40 μm is developed with a developer containing the above toner having the specific particle distribution characteristics, the resolution and transferring efficiency are improved so that clear and sharp electrophotographic images free of unevenness of transferring efficiency of the toner from the photoreceptor to the intermediate transferring member can be obtained.

The 50 percent volume particle diameter (Dv50) is preferably from 2 to 8 μm, more preferably from 3 to 7 μm. By adjusting the diameter to the above range, it is possible to enhance high resolution. By adjusting Dv50/Dp50 and Dv75/Dp75 to the specified values as well as by adjusting Dv50 to such a value, it is possible to reduce the portion of toner particles having a minute particle diameter, even though the toner is containing particles having a relatively small diameter, and it is possible to improve cleaning properties and toner transferring rate over an extended period of time, thereby forming stable images that are clear and sharp.

The cumulative 75 percent volume particle diameter (Dv75) from the largest particle in terms of volume standard distribution and the cumulative 75 number particle diameter (Dp75) from the largest particle in terms of number standard distribution, as described herein, refer to the volume particle diameter and the number particle diameter at the position of the particle size distribution which show 75 percent of the cumulative frequency with respect to the sum of the volume and the sum of the number from the largest particle.

The 50 percent volume particle diameter (Dv50), 50 percent number particle diameter (Dp50), cumulative 75 percent volume particle diameter (Dv75), and cumulative 75 percent number particle diameter (Dp75) may be determined by measurement with a Coulter Counter Type TAII or a Coulter Multisizer (both are manufactured by Coulter Inc.).

The proportion of toner particles having a diameter of 0.7×Dp50 or less is 10 percent by number. The amount of such small particle toner may be measured employing an Electrophoretic Light Scattering Spectrophotometer ELS-800, manufactured by Otsuka Electronics Co., Ltd.

In the technical field of electrostatic latent images are visualized employing dry system development, as an electrostatic-image developing toner employed are those which are prepared by adding an external additive to color particles (mother toner particles) containing at least a colorant and a binder resin. However, as long as specifically there occurs no problems, it is generally described that the color particles are not differentiated from the electrostatic latent image developing toner. The particle diameter and particle size distribution of the toner particles and colored particles hardly show the difference in the same measurement values.

The particle diameter of external additive is in an order of nm in terms of the number average primary particle. It is possible to determine the diameter employing an Electrophoretic Light Scattering Spectrophotometer "ELS-800" (manufactured by Otsuka Electronics Co., Ltd.).

The constitution and production method of the toner having the above described particle size distribution will now be described in detail below.

<Toner>

It is preferable to use a coalesced type toner which is prepared by salting out and fusing resinous particles comprising a release agent and colorant particles.

The reason is estimated that toner having an aforesaid particle size distribution can be manufactured as well as a coalesced type toner is provided with the surface properties being homogeneous among particles without disturbing the transfer property resulting in sufficient exhibition of effects of this invention.

The "salting-out/fusion", as described above, refers to simultaneous occurrence of salting-out (aggregation of particles) and fusion (disappearance of the boundary surface among particles) or an operation to render salting-out and fusion to occur simultaneously. In order to render salting-out and fusion to occur simultaneously, it is necessary to aggregate particles (resinous particles and colorant particles) at temperatures higher than or equal to the glass transition temperature (Tg) of resins constituting the resinous particles.

<Releasing Agent>

The releasing agent employable is not specifically limited. However, it is preferred that a crystalline ester compound (hereinafter named "specific ester compounds") of the following formula (1) be used as the releasing agent: General formula (1): $R_1—(OCO—R_2)_n$ ($R_1$ and $R_2$ each represent a hydrocarbon group having 1 to 40 carbon atoms, which may have a substituent and n is an integer from 1 to 4.)

<Specific Ester-Compounds>

In the general formula (1) of the specific ester compounds, $R_1$ and $R_2$ each represent hydrocarbon group which may have a substituent.

The hydrocarbon group $R_1$ preferably has from 1 to 20 carbon atoms, more preferably from 2 to 5 carbon atoms.

The hydrocarbon group $R_2$ preferably has from 16 to 30 carbon atoms, more preferably from 18 to 26 carbon atoms. In the general formula (1), the integer n is preferably from 2 to 4, more preferably 3 or 4 and particularly 4.

The specific ester compound may be synthesized by a dehydration condensation reaction of an alcohol compound and a carbonic acid.

Especially preferable example of the specific ester compound is pentaerthritoltetrabehenic acid ester. Examples of the specific ester compound include those represented by the following formulas 1) to 22):

1) $CH_3—(CH_2)_{12}—COO—(CH_2)_{17}—CH_3$

2) $CH_3—(CH_2)_{18}—COO—(CH_2)_{17}—CH_3$

3) $CH_3—(CH_2)_{20}—COO—(CH_2)_{21}—CH_3$

4) $CH_3—(CH_2)_{14}—COO—(CH_2)_{19}—CH_3$

5) $CH_3—(CH_2)_{20}—COO—(CH_2)_6—O—CO—(CH_2)_{20}—CH_3$

6) $CH_3—(CH_2)_{20}—COO—(CH_2)_2—CH(CH_3)—CH_2—O—CO—(CH_2)_{20}—CH_3$

7) $CH_3—(CH_2)_{22}—COO—(CH_2)_2—CH(CH_3)—CH_2—O—CO—(CH_2)_{22}—CH_3$

8) $CH_3—(CH_2)_{22}—COO—CH_2—C(CH_3)_2—CH_2—O—CO—(CH_2)_{22}—CH_3$

9) $CH_3—(CH_2)_{26}—COO—CH_2—C(CH_3)_2—CH_2—O—CO—(CH_2)_{26}—CH_3$

10) $CH_2—O—CO—(CH_2)_{26}—CH_3$
$CH—O—CO—(CH_2)_{26}—CH_3$
$CH_2—O—CO—(CH_2)_{26}—CH_3$

11) $CH_2—O—CO—(CH_2)_{22}—CH_3$
$CH—O—CO—(CH_2)_{22}—CH_3$
$CH_2—O—CO—(CH_2)_{22}—CH_3$

12) $CH_2—OH$
$CH—O—CO—(CH_2)_{26}—CH_3$
$CH_2—O—CO—(CH_2)_{26}—CH_3$

13) $CH_2—OH$
$CH—O—CO—(CH_2)_{22}—CH_3$
$CH_2—O—CO—(CH_2)_{22}—CH_3$

14) $CH_2—OH$
$CH—OH$
$CH_2—O—CO—(CH_2)_{26}—CH_3$

-continued

15)

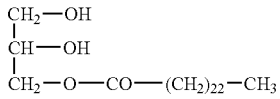

16)

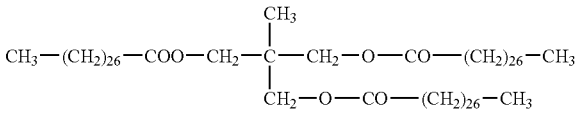

17)

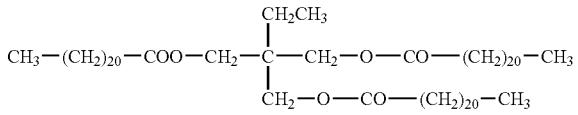

18)

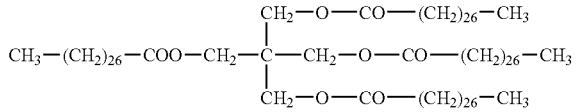

19)

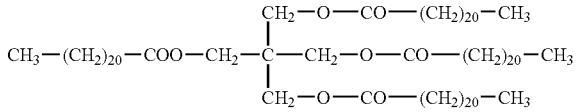

20)

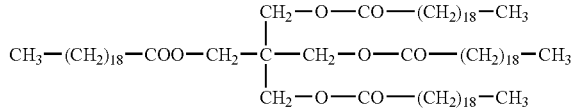

21)

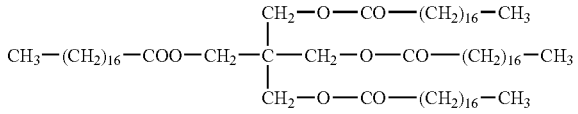

22)

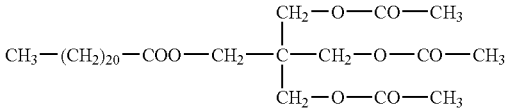

<Content of the Releasing Agent>

The amount of the releasing agent in the toner is generally from 1 to 30 percent by mass, preferably from 2 to 20 percent by mass, particularly preferably from 3 to 15 percent by mass.

<Resinous Particles Comprising Releasing Agent>

The "resinous particles containing a releasing agent" may be obtained as latex particles by dissolving the releasing agent in a monomer to obtain a binding resin, and then dispersing the resulting monomer solution into water based medium, and subsequently polymerizing the resulting dispersion.

The weight average particle diameter of the resinous particles is preferably 50 to 2,000 nm.

Examples of the polymerization method employed to obtain resinous particles, in which binding resins comprise releasing agents, include granulation polymerization methods such as an emulsion polymerization method, a suspension polymerization method, a seed polymerization method, and the like.

The following method (hereinafter referred to as an "mini-emulsion method") may be mentioned as a preferable polymerization method to obtain resinous particles comprising releasing agents. A monomer solution, which is prepared by dissolving releasing agents in monomers, is dispersed into a water based medium prepared by dissolving surface active agents in water at a concentration of less than the critical micelle concentration so as to form oil droplets in water, while utilizing mechanical energy. Subsequently, water-soluble polymerization initiators are added to the resulting dispersion and the resulting mixture undergoes radical polymerization. Further, instead of adding the water-soluble polymerization initiators, or along with the water-soluble polymerization initiators, oil-soluble polymerization initiators may be added to the monomer solution.

A dispersing device for forming an oil droplets in water dispersion, utilizing mechanical energy, is not particularly limited, and may be, for example, a stirrer "CLEARMIX" (produced by M-Technic Co., Ltd.) provided with a high speed rotor, ultrasonic dispersing device, a mechanical homogenizer, a Manton-Gaulin homogenizer, a pressure type homogenizer, and the like. Further, the diameter of dispersed particles is generally 10 to 1,000 nm, and is preferably 30 to 300 nm.

<Binder Resin>

The binder resin, which constitutes the toner, is preferably a resin which comprises high molecular weight components having a peak, or a shoulder, in the region of 100,000 to 1,000,000, as well as low molecular weight components having a peak, or a shoulder, in the region of 1,000 to 20,000 in terms of the molecular weight distribution determined by GPC.

A method for measuring the molecular weight of resins, employing GPC, is as follows. Added to 1 ml of THF is a measured sample in an amount of 0.5 to 5.0 mg (specifically, 1 mg), and is sufficiently dissolved at room temperature while stirring employing a magnetic stirrer and the like. Subsequently, after filtering the resulting solution employing a membrane filter having a pore size of 0.45 to 0.50 μm, the filtrate is injected in a GPC.

Measurement conditions of GPC are described below. A column is stabilized at 40° C., and THF is flowed at a rate of 1 ml per minute. Then measurement is carried out by injecting approximately 100 μl of the sample at a concentration of 1 mg/ml. It is preferable that commercially available polystyrene gel columns are combined and used. For example, it is possible to cite combinations of Shodex GPC KF-801, 802, 803, 804, 805, 806, and 807, produced by Showa Denko Co., Ltd. combinations of TSKgel G1000H, G2000H, G3000H, G4000H, G5000H, G6000H, G7000H, TSK guard column, produced by Tosoh Co., Ltd. As a detector, a refractive index detector (IR detector) or a UV detector is preferably employed. When the molecular weight of samples is measured, the molecular weight distribution of the sample is calculated employing a calibration curve which is prepared employing monodispersed polystyrene as standard particles. Approximately ten polystyrene samples are preferably employed for determining the calibration curve.

The composition materials of resinous particles and the preparation method (polymerization method) thereof will now be described.

[Monomer]

Of polymerizable monomers which are employed to prepare resinous particles, radical polymerizable monomers are essential components, and if desired, crosslinking agents may be employed. Further, at least one of the radical polymerizable monomers having an acidic group or radical polymerizable monomers having a basic group, described below, is preferably incorporated.

(1) Radical Polymerizable Monomers

Radical polymerizable monomers are not particularly limited. It is possible to employ conventional radical polymerizable monomers known in the art. Further, they may be employed in combination of two or more types so as to satisfy desired properties.

Specifically, employed may be aromatic vinyl monomers, acrylic acid ester based monomers, methacrylic acid ester based monomers, vinyl ester based monomers, vinyl ether based monomers, monoolefin based monomers, diolefin based monomers and halogenated olefin monomers.

As the aromatic vinyl monomer, there may be mentioned, for example, styrene based monomers and derivatives thereof such as styrene, o-methylstyrene, m-methylstyrene, p-methylstyrene, p-methoxystyrene, p-phenylstyrene, p-chiorostyrene, p-ethylstyrene, p-n-butylstyrene, p-tert-butylstyrene, p-n-hexylstyrene, p-n-octylstyrne, p-n-nonylstyrene, p-n-decylstyrene, p-n-dodecylstyrene, 2,4-dimethylstyrne and 3,4-dichlorostyrene.

As the acrylic acid ester based monomers and methacrylic acid ester monomers, there may be mentioned, for example, methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxyacrylate, propyl γ-aminoacrylate, stearyl methacrylate, dimethyl aminoethyl methacrylate and diethyl aminoethyl methacrylate.

Examples of the vinyl ester based monomer include vinyl acetate, vinyl propionate and vinyl benzoate.

Examples of the vinyl ether based monomer include vinyl methyl ether, vinyl ethyl ether, vinyl isobutyl ether and vinyl phenyl ether.

Examples of the monoolefin based monomer include ethylene, propylene, isobutylene, 1-butene, 1-pentene and 4-methyl-1-pentene.

Examples of the diolefin based monomer include butadiene, isoprene and chloroprene.

Examples of the halogenated olefin based monomer include vinyl chloride, vinylidene chloride and vinyl bromide.

(2) Crosslinking Agent

A radical polymerizable crosslinking agent may be used to improve the desired properties of toner. Examples of the radical polymerizable crosslinking agent include those having at least two unsaturated bonds such as divinylbenzene, divinylnaphthalene, divinyl ether, diethylene glycol methacrylate, ethylene glycol dimethacrylate, polyethylene glycol dimethacrylate and diallyl phthalate.

(3) Radical Polymerizable Monomers Having an Acidic Group or a Basic Group

As radical polymerizable monomers having an acidic group or a basic group, there may be mentioned, for example, amine based compounds such as monomers having a carboxyl group, monomers having a sulfonic acid group, and amine based compounds such as primary, secondary, and tertiary amines and quaternary ammonium salts.

The radical polymerizable monomer having an acidic group may be a monomer having a carboxyl group, such as acrylic acid, methacrylic acid, fumaric acid, maleic acid, itaconic acid, cinnamic acid, monobutyl maleate or monooctyl maleate.

Examples of the monomers having sulfonic acid include styrenesulfonic acid, allylsulfosuccinic acid and octyl allylsulfosuccinate.

The above monomers may be in the form of salts of alkali metals such as sodium or potassium, or salts of alkali earth metals such as calcium.

As the radical polymerizable monomer having a basic group, there may be mentioned amine based compounds. Examples of the amine compound include dimethylaminoethyl acrylate, dimethylaminoethyl methacrylate, diethylaminoethyl acrylate, diethylaminoethyl methacrylate, and quaternary ammonium salts of these four compounds; 3-dimethylaminophenyl acrylate, 2-hydroxy-3-methacryloxypropyl-trimethylammonium salt; acrylamide, N-butylacrylamide, N,N-dibutylacrylamide, piperidylacrylamide, methacrylamide, N-butylmethacrylamide, N-octadecylacrylamide; vinylpyridine; vinylpyrrolidone; vinyl N-methylpyridinium chloride, vinyl N-ethylpyridinium chloride, N,N-diallylmethylammonium chloride and N,N-diallylethylammonium chloride.

The amount of the radical polymerizable monomer having an acidic group or a basic group is preferably 0.1 to 15 percent by mass based on a total weight of the monomers, although the range is dependent on the characteristic. The amount of the radical polymerizable crosslinking agent is preferably 0.1 to 10 percent by mass based on a total weight of the radical polymerizable monomers.

[Chain Transfer Agent]

For the purpose of regulating the molecular weight of resinous particles, it is possible to employ a customarily used chain transfer agent. The chain transfer agent is not particularly limited. Examples of the chain transfer agent include mercaptans such as octylmercaptan, dodecylmercaptan and tert-dodecylmercaptan, mercaptopropionates such as n-octyl-3-mercaptopropionate, carbon tetrabromide, and styrene dimer.

[Polymerization Initiator]

A radical polymerization initiator may be suitably employed, as long as it is water-soluble. Examples of the polymerization initiator include persulfate salts (e.g. potassium persulfate and ammonium persulfate), azo based compounds (4,4'-azobis-4-cyanovaleric acid and salts thereof and 2,2'-azobis(2-amidinopropane) salts) and peroxides.

Further, if desired, it is possible to employ the radical polymerization initiators as redox based initiators by combining them with reducing agents. By employing the redox based initiators, it is possible to increase polymerization activity and decrease polymerization temperature so that a decrease in polymerization time is expected.

The polymerization temperature is not specifically limited, as long as it is higher than the lowest radical formation temperature of the polymerization initiator. For example, the temperature range of 50 to 90° C. is employed. However, by employing a combination of polymerization initiators such as hydrogen peroxide-reducing agent (ascorbic acid and the like), which is capable of initiating the polymerization at room temperature, it is possible to carry out polymerization at least room temperature.

[Surface Active Agent]

In order to perform polymerization employing the aforementioned radical polymerizable monomers, it is preferable to conduct oil droplet dispersion in a water based medium employing a surface active agent. Surface active agents, which are employed for the dispersion, are not particularly limited, and it is possible to cite ionic surface active agents described below as suitable ones.

Examples of the ionic surface active agent include sulfonic acid salts (sodium dodecylbenzenesulfonate, sodium arylalkyl polyethersulfonate, sodium 3,3-disulfondiphenylurea-4,4-diazo-bis-amino-8-naphthol-6-sulfonate, sodium orthocaroxybenzene-azo-dimethylaniline, 2,2,5,5-tetramethyltriphenylmethane-4,4-diazi-bis-β-naphthol-6-sulfonate) and sulfuric acid ester salts (sodium dodecylsulfonate, sodium tetradecylsulfonate, sodium pentadecylsulfonate and sodium octylsulfonate), fatty acid salts (sodium oleate, sodium laureate, sodium caprate, sodium caprylate, sodium caproate, potassium stearate and calcium oleate).

Further, a nonionic surface active agent may also be employed. Examples of the nonionic surface active agent include polyethylene oxide, polypropylene oxide, a combination of polypropylene oxide and polyethylene oxide, alkylphenol polyethylene oxide, esters of polyethylene glycol with higher fatty acids, esters of polypropylene oxide with higher fatty acids and sorbitan esters.

<Colorant>

As a colorant contained in the toner, there may be used an inorganic pigment, an organic pigment or a dye.

The inorganic pigment may be one which is conventionally known in the art. Specific examples of the inorganic pigment are exemplified below.

As a black pigment such as carbon black (e.g. furnace black, channel black, acetylene black, thermal black and lamp black), and in addition, magnetic powders such as magnetite and ferrite.

If desired, the inorganic pigment may be employed individually or in combination of a plurality of these. Further, the added amount of the pigments is generally between 2 and 20 percent by mass, preferably between 3 and 15 percent by mass, based on the polymer.

When the toner is employed as a magnetic toner, it is possible to add magnetite. In that case, from the viewpoint of providing specified magnetic properties, the magnetite is incorporated into the toner preferably in an amount of 20 to 60 percent by mass.

As the organic pigment and dye, publicly know ones may be employed. Specific examples of the organic pigments and dyes are exemplified below.

Examples of magenta and red pigments include C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178 and C.I. Pigment Red 222.

Examples of orange and yellow pigments include C.I. Pigment Orange 31, C.I. Pigment Orange 43, C.I. Pigment Yellow 12, C.I. Pigment Yellow 13, C.I. Pigment Yellow 14, C.I. Pigment yellow 15, C.I. Pigment Yellow 17, C.I. Pigment Yellow 93, C.I. Pigment Yellow 94, C.I. Pigment Yellow 138, C.I. Pigment yellow 180, C.I. Pigment Yellow 185, C.I. Pigment Yellow 155 and C.I. Pigment Yellow 156.

Examples of the green and cyan pigments include C.I. Pigment Blue 15, C.I. Pigment Blue 15:2, C.I. Pigment Blue 15:3, C.I. Pigment Blue 16, C.I. Pigment Blue 60 and C.I. Pigment Green 7.

Examples of the dye include C.I. Solvent Red 1, 49, 52, 58, 63, 111, 122; C.I. Solvent Yellow 19, 44, 77, 79, 81, 82, 93, 98, 103, 104, 112, 162; C.I. Solvent Blue 25, 36, 60, 70, 93 and 95. Further these may be employed in combination as a mixture.

These organic pigments and dyes may be employed individually or in combination of selected ones, if desired. The amount of the pigment is generally between 2 and 20 percent by mass, preferably between 3 and 15 percent by mass, based on the polymer.

The colorant may also be employed after being subjected to surface modification. As the surface modifying agent, those conventionally known in the art may be used. Specific examples of the modifying agent include silane coupling agents, titanium coupling agents and aluminum coupling agents.

<External Additive>

For the purpose of improving fluidity as well as chargeability, and of enhancing cleaning properties, the toner may be employed in conjunction with a so-called external additive. The external additive is not particularly limited, and various types of fine inorganic particles, fine organic particles, and lubricants may be employed.

The fine inorganic particles may be those conventionally known in the art. Specific examples of the inorganic particles include silica, titanium and alumina particles. These fine inorganic particles are preferably hydrophobic. Specific examples of commercially available fine silica particles include R-805, R-976, R-974, R-972, R-812, and R-809 manufactured by Nippon Aerosil Co.; HVK-2150 and H-200 manufactured by Hoechst Co.; TS-720, TS-530, TS-610, H5, and MS5 manufactured by Cabot Corp.

Specific examples of commercially available fine titanium particles include T-805 and T-604 manufactured by Nippon Aerosil Co.; MT-100S, MT-100B, MT-500BS, MT-600, MT-600SS and JA-1 manufactured by Teika Co.; TA-300SI, TA-500, TAF-130, TAF-510 and TAF-510T manufactured by Fuji Titan Co.; and IT-S, IT-OA, IT-OB and IT-OC manufactured by Idemitsu Kosan Co.

Specific examples of commercially available fine alumina particles include RFY-C and C-604 manufactured by Nippon Aerosil Co.; and TTO-55 manufactured by Ishihara Sangyo Co.

Further, as fine organic particles, there may be used fine spherical organic particles having a number average primary particle diameter of 10 to 2,000 nm. The organic particles may be those of a homopolymer or copolymer of styrene or methyl methacrylate.

The lubricant may be, for example, a metal salt of a higher fatty acid, such as a salt of stearic acid with a metal such as zinc, aluminum, copper, magnesium or calcium; a salt of oleic acid with a metal such as zinc, manganese, iron, copper or magnesium; a salt of palmitic acid with a metal such as zinc, copper, magnesium or calcium; a salt of linoleic acid with a metal such as zinc or calcium; or a salt of ricinolic acid with a metal such as zinc or calcium.

The amount of the external agent is preferably 0.1 to 5 percent by mass based on the toner.

It is preferred that the toner be a coalesced type toner obtained by salting out/fusing resinous particles comprising releasing agents and colorant particles in a water based medium. By salting out/fusing the resinous particles comprising releasing agents, as described above, a toner is obtained in which the releasing agents are finely depressed. Further, such a toner exhibits stable chargeability in addition to the effects attained by the specific particle diameter distribution characteristics.

In addition, the toner particles have uneven surfaces as from the production stage, and a coalesced type toner is obtained by fusing resinous particles and colorant particles. Therefore, differences in the shape as well as surface properties among toner particles are minimal. As a result, the surface properties tend to be uniform. Thus difference in charging and transferring properties among toner particles tends to be minimized so that it is possible to maintain excellent charging and transferring properties.

<Toner Production Process>

One example of the method for producing the toner is as follows:

(1) a dissolution process in which a releasing agent is dissolved in a monomer to obtain a monomer solution;
(2) a dispersion process in which the resulting monomer solution is dispersed into a water based medium;
(3) a polymerization process in which the resulting water based dispersion of the monomer solution is subjected to polymerization so that dispersion (latex) of resinous particles comprising the releasing agents is prepared;
(4) a salting-out/fusion process in which the resulting resinous particles and the colorant particles are subjected to salting-out/fusion in a water based medium to obtain coalesced particles (toner particles);
(5) a filtration and washing process in which the resulting coalesced particles are collected from the water based medium employing filtration, and surface active agents and the like are removed from the coalesced particles;
(6) a drying process in which washed coalesced particles are dried; and
(7) an external additive addition process may be optionally included in which an external additives is added to the dried-coalesced particles.

[Dissolution Process]

Methods for dissolving releasing agents in monomers are not particularly limited.

The amount of the releasing agent dissolved in the monomer is such that the final toner contains generally 1 to 30 percent by mass, preferably 2 to 20 percent by mass, more preferably 3 to 15 percent by mass, of the releasing agent.

If desired, an oil-soluble polymerization initiator and an oil-soluble components may be incorporated into the monomer solution.

[Dispersion Process]

Methods for dispersing the monomer solution into a water based medium are not particularly limited. However, a method is preferred in which dispersion is carried out employing mechanical energy. The monomer solution is preferably subjected to oil droplet dispersion (essentially an embodiment in a mini-emulsion method), employing mechanical energy, especially into a water based medium prepared by dissolving a surface active agent at a concentration of lower than its critical micelle concentration.

A dispersing device to conduct oil droplet dispersion employing mechanical energy, is not particularly limited. For example, "CLEARMIX", an ultrasonic homogenizer, a mechanical homogenizer, a Manton-Gaulin homogenizer or a pressure type homogenizer may be used. Further, the dispersion diameter is generally 10 to 1,000 nm, preferably 30 to 300 nm.

[Polymerization Process]

Basically, any conventionally known polymerization method, such as an emulsion polymerization method, a suspension polymerization method or a seed polymerization method, may be employed.

One example of the preferred polymerization method is a mini-emulsion method, in which radical polymerization is carried out by adding a water-soluble polymerization initiator to a dispersion obtained by oil droplet dispersing a monomer solution, employing mechanical energy, into a water based medium prepared by dissolving a surface active agent at a concentration lower than its critical micelle concentration.

[Salting-Out/Fusion Process]

In the salting-out/fusion process, a colorant particle dispersion is added to a dispersion containing resinous particles obtained by the polymerization process so that the resinous particles and the colorant particles are subjected to salting-out/fusion in a water based medium.

Further, in the salting-out/fusion process, internal agent particles such as of a charge controlling agent may be fused and adhered together with the resinous particles and the colorant particles.

The water based medium as used herein refers to a medium containing water as a major component (at least 50 percent by mass). Components other than water may include a water-soluble organic solvent. Illustrative of suitable solvents are methanol, ethanol, isopropanol, butanol, *acetone, methyl ethyl ketone and tetrahydrofuran. Of these, an alcohol such as methanol, ethanol, isopropanol or butanol in which a resin is not dissolved is preferably used.

The colorant particles employed in the salting-out/fusion process may be prepared by dispersing colorants into a water based medium. Dispersion of the colorant particles may be carried out in a state that the concentration of the surface active agent in water is adjusted to at least critical micelle concentration (CMC).

A dispersing device used to disperse colorant particles is not particularly limited. Examples of the dispersing device include "CLEARMIX", ultrasonic homogenizers, mechanical homogenizers, Manton-Gaulin and pressure type homogenizers, and medium type homogenizers such as sand grinders, Getman mill and diamond fine mills. Further, the surface active agent used in the salting-out/fusion process may be the same as the previously described surfactant.

The colorant particles may be surface-modified. One suitable surface modification method is as follows; colorant particles are dispersed in a solvent, and a surface-modifier is added to the resulting dispersion. Subsequently the resulting mixture is heated to start reaction. After completing the reaction, colorant particles are collected by filtration and repeatedly washed with the same solvent. Subsequently, the washed colorant particles are dried to obtain the colorant (pigment) which have been treated with the surface modifier.

The salting-out/fusion process is a process in which a salting-out agent containing an alkaline metal salt and/or an alkaline earth metal salt is added to an aqueous medium containing resinous particles and colorant particles as the coagulant at a concentration higher than the critical aggregation concentration. Subsequently, the resulting aggregation is heated above the glass transition point of the resinous particles so that fusion is carried out while simultaneously conducting salting-out. During this process, an organic solvent which is infinitely soluble in water may be added.

In the alkali metal salt or alkaline earth metal salt employed as a salting-out agent, the alkali metal may be lithium, potassium or sodium, while the alkaline earth metal may be magnesium, calcium, strontium or barium. Of these, potassium, sodium, magnesium, calcium and barium are preferable. The salt may be a chloride, a bromide, an iodide, a carbonate or a sulfate.

Examples of the organic solvent, which is infinitely soluble in water, include methanol, ethanol, 1-propanol, 2-propanol, ethylene glycol, glycerin, or acetone. Of these, preferred are alcohols having not more than 3 carbon atoms, such as methanol, ethanol, 1-propanol and 2-propanol, and specially, 2-propanol is preferable.

In the salting-out/fusion process, it is preferred that the hold-over time after the addition of the salting-out agent be as short as possible. Namely, it is preferred that, after the addition of the salting-out agent, the dispersion containing resinous particles and colorant particles be heated as soon as possible to a temperature higher than the glass transition point of the resinous particles.

The reason for this is not well understood. However, problems occur in which the aggregation state of particles varies depending on the hold-over time after salting out so that the particle diameter distribution becomes unstable and surface properties of fused toner particles fluctuate.

The period of time from the addition of the salting-out agent to the start of heating (hold-over time) is generally not more than 30 minutes, preferably not more than 10 minutes.

The temperature at which the salting-out agent is added is not particularly limited, and is preferably not higher than the glass transition temperature of resinous particles.

Further, in the salting-out/fusion process, it is desired that the temperature be quickly increased by heating. The rate of temperature increase is preferably no less than 1° C./minute. The maximum rate of temperature increase is not particularly limited. However, in view of preventing the formation of coarse grains due to rapid salting-out/fusion, the rate is preferably not more than 15° C./minute.

After the dispersion containing resinous particles and colorant particles has been heated to a temperature higher than the glass transition point, it is important to continue the salting-out/fusion by maintaining the temperature of the dispersion for a specified period of time. Thereby, the growth of toner particles (aggregation of resinous particles as well as colorant particles) and fusion (disappearance of the interface between particles) are effectively proceeded. As a result, it is possible to enhance the durability of the finally obtained toner.

Further, after terminating the growth of coalesced particles, fusion by heating may be continued.

[Filtration and Washing]

In the filtration and washing process, the toner particles are collected by filtration from the toner particle dispersion obtained by the process previously described. In the washing step, adhered materials such as the surface active agent and salting-out agent are removed from the collected toner particles (a caked aggregation).

The filtration method is not particularly limited, and may be a centrifugal separation method, a vacuum filtration method which is carried out employing Nutsche, a filtration method which is carried out employing a filter press.

[Drying Process]

The washed toner particles are then dried in this process.

As a dryer employed in this process, there may be used a spray dryer, a vacuum freeze dryer or a vacuum dryer. Further, a standing tray dryer, a movable tray dryer, a fluidized-bed layer dryer, a rotary dryer or a stirring dryer may also be preferably employed.

It is preferred that the moisture content of the dried toner be not more than 5 percent by mass, more preferably not more than 2 percent by mass.

Further, when the dried toner particles are aggregated due to weak attractive forces among particles, aggregates may be subjected to pulverization treatment. As a pulverization device, there may be used a mechanical pulverization device such as a jet mill, a Henschel mixer, a coffee mill, or a food processor.

[External Additive Addition Process]

In the external additive addition process, an external additive is added to the dried toner particles using a suitable known mixing device such as a turbulent mixer, a Henschel mixer, a Nauter mixer or a V-type mixer.

As described previously, the amount of the toner particles having a diameter of 0.7×Dp50 or less should be 10 percent by number or less. In order to control the toner diameter distribution to fall in this range, it is preferable to reduce the time period for temperature control, that is, to elevate the temperature as fast as possible in the salting-out/fusion stage. The time for elevation is preferably 30 minutes or less, more preferably 10 minutes or less, and the heating rate is preferably 1° C. to 15° C./minute.

Besides the colorant and releasing agent, other materials which provide various functions as toner materials may be incorporated into the toner. Specifically, a charge control agent may be suitably used. These materials may be added employing various methods such as one in which, during the salting-out/fusion stage, the charge control agent is simultaneously added to the resinous particles and colorant particles so as to be incorporated into the toner. Alternatively, the charge control agent may be incorporated into resinous particles.

Any conventionally used charge control agent capable of being dispersed in water may be used. Specific examples of the charge controlling agent include nigrosine based dyes, metal salts of naphthenic acid or higher fatty acids, alkoxyamines, quaternary ammonium salts, azo based metal complexes, salicylic acid metal salts and metal complexes thereof.

<Developer>

The toner may be employed in either a single-component developer or a two-component developer.

In the case of the single-component developer, both a non-magnetic single-component developer and a magnetic single-component developer in which magnetic particles having a diameter of 0.1 to 0.5 μm are incorporated into the toner may be employed.

The toner may be blended with a carrier to form a two-component developer. In this case, as magnetic particles of the carrier, there may be used conventional materials known in the art, for example metals such as iron, ferrite, magnetite, alloys of those metals with aluminum or lead. Specifically, ferrite particles are preferred. The volume average particle (D4)diameter of the magnetic particles is preferably 15 to 100 μm, more preferably 25 to 80 μm.

The volume average particle diameter of the carrier can be generally determined employing a laser diffraction type particle size distribution measurement apparatus "HELOS", produced by Sympatec Co., which is provided with a wet type homogenizer.

The preferred carrier is one in which magnetic particles are further coated with resins, or a so-called resin dispersion type carrier in which magnetic particles are dispersed into resins. Resin compositions for coating are not particularly limited. For example, employed are olefin based resins, styrene based resins, styrene-acryl based resins, silicone based resins, ester based resins, or fluorine containing polymer based resins. Further, resins, which constitute the resin dispersion type carrier, are not particularly limited, and resins known in the art may be employed. For example, listed may be styrene-acryl based resins, polyester resins, fluorine based resins and phenol resins.

EXAMPLE

In the following, examples of this invention will be described. However, this invention is not limited thereto.

Example 1

Preparation of Cylindrical Substrate

1. Manufacturing Method of Cylindrical Substrate a. Manufacturing of Cylindrical Substrate A-1

A cylindrical substrate (length L=344 mm, diameter ϕ (inner diameter)=100 mm), which was formed by means of extraction process and comprised of aluminum alloy having a thickness of 2.00 mm, at the inside diameter of which a stainless steel holder was pressing held by use of a contact pressure variation means 3-8 illustrated in FIG. 8 was subjected to in-low processing of a diameter Φ=98.40 mm based on outer diameter standard and of a length d=8 mm (Precision CNC Both Edges Processing Device BS, produced by Egulo Co., Ltd., was utilized for in-low processing).

Thereafter, the both edges of the above-described cylindrical substrate was gripped by the aforesaid non-sliding type opening-and-closing chuck and the substrate surface was cutting processed according to an inner diameter standard of the in-low processed portion. A cylindricity of finished cylindrical substrate A-1 was 8 μm.

b. Manufacturing of Cylindrical Substrate A-2

In-low and cutting processing was performed in a similar manner to the in-low processing of cylindrical substrate A-1, except that D=214 mm (0.60×L). A cylindricity of finished cylindrical substrate A-2 was 25 μm.

c. Manufacturing of Cylindrical-Substrate A-3

In-low and cutting processing was performed in a similar manner to the in-low processing of cylindrical substrate A-1, except that D=143 mm (0.40×L). A cylindricity of finished cylindrical substrate A-3 was 35 μm.

d. Manufacturing of Cylindrical Substrate A-4

In-low and cutting processing was performed in a similar manner to the in-low processing of cylindrical substrate A-1, except that D=332 mm (0.93×L). A cylindricity of finished cylindrical substrate A-3 was 28 μm.

e. Manufacturing of Cylindrical Substrate B-1 (Outside Gripping (Out of this Invention))

Figure 10:
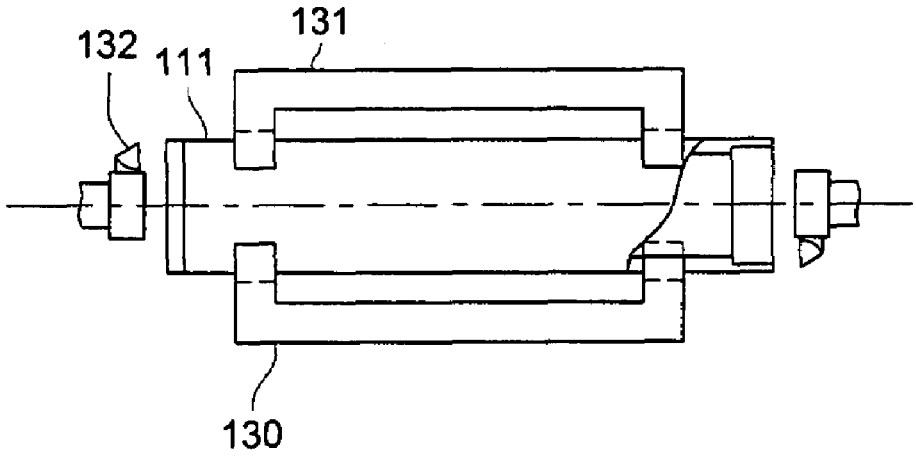
FIG. 10 shows an example of in-low process by outside gripping.

In-low and cutting processing was performed in a similar manner to processing of cylindrical substrate A-1, except that a holder was not inserted inside of a cylindrical substrate but the substrate was set on a gripping means, that is, fixed V receiving table 30 illustrated in FIG. 10 (an example of in-low processing by outside gripping of a substrate) and the outer diameter of cylindrical substrate 11 was fixed from the outside with a pressing V receiving table 31, followed by in-low processing (for example, Precision CNC Both Edges Processing Device UB-600, produced by Egulo Co., Ltd., was utilized) was performed by use of rotational driving blades 32 located on the left and right sides. A cylindricity of finished cylindrical substrate B-1 was 45 μm.

2. Preparation of Photoreceptor

"Part(s)" in the following description represents a weight %.

Preparation of Photoreceptor 1

Photoreceptor 1 was prepared as follows utilizing cylindrical support A-1.

<Intermediate Layer>

After washing cylindrical substrate A-1, the following intermediate layer composition solution was coated by an immersion coating method, resulting in preparation of an intermediate layer having a dry layer thickness of 2 μm.

The following intermediate layer dispersion was diluted by two times with the same mixed solvent, and was filtered (filter: Ridimesh Filter having a nominal filtering precision of 5 μm, manufactured by Nippon Pole Filter Corp., pressure: $5\times10^4$ Pa) after having been kept still for one night, resulting in preparation of an intermediate layer composition solution.

Intermediate Layer Dispersion

| | |
|---|---|
| Polyamide resin CM8000 (Toray Industries Inc.) | 1 part |
| Titanium oxide SMT500SAS (manufactured by Teika Co., Ltd., surface treatment: silica, alumina and methyl hydrogen polysiloxane treatment) | 3.0 parts |
| Methanol | 10 parts |

The above composition was dispersed by use of a sand mill as a homogenizer for 10 hours in a batch mode, resulting in preparation of an intermediate layer dispersion. Said intermediate layer dispersion-was diluted by two times with the same mixed solvent, and was filtered (filter: Ridimesh Filter having a nominal filtering precision of 5 μm, manufactured by Nippon Pole Filter Corp., pressure: $5\times10^4$ Pa) after having been kept still for one night, resulting in preparation of an intermediate layer composition solution. After washing cylindrical substrate A-1, this intermediate layer composition solution was coated on said substrate by an immersion coating method, resulting in preparation of an intermediate layer having a dry layer thickness of 2 μm.

<Charge Generating Layer>

| | |
|---|---|
| Charge generating substance: titanyl phthalocyanine pigment (titanyl phthalocyanine pigment having the maximum peak of Bragg angle 2θ (±0.2) at 27.2° based on a Cu—Kα characteristic X-ray diffraction spectrum measurement) | 20 parts |
| Polyvinyl butyral resin (#6000-C, manufactured by Denki Kagaku Kogyo K.K.) | 10 parts |
| t-Butyl acetate | 700 parts |
| 4-methoxy-4-methyl-2-pentane | 300 parts |

The above composition was mixed and dispersed for 10 hours by use of a sand mill, resulting in preparation of a charge generating layer coating solution. This solution was coated on the aforesaid intermediate layer by means of an immersion coating method to form a charge generating layer having a dry layer thickness of 0.3 μm.

<First Charge Transporting Layer>

| | |
|---|---|
| Charge transporting substance (T-1) | 200 parts |
| Polycarbonate (PC-1: viscosity average molecular weight of 27000) | 300 parts |

-continued

| <First Charge Transporting Layer> | |
|---|---|
| Anti-oxidant (Irganox 1010: manufactured by Ciba-Geigy Corp.) | 6 parts |
| Dichloromethane | 2000 parts |
| Silicone oil (KF-54: manufactured by Shin-Etsu Chemical Co., Ltd.) | 1 part |

The above composition was mixed and dissolved to prepare a charge transporting layer coating solution. This solution was coated on the aforesaid charge generating layer by means of an immersion coating method to form the first charge transporting layer having a dry layer thickness of 15 μm.

| <Second Charge Transporting Layer: Front Surface Layer> | |
|---|---|
| Charge transporting substance (T-1) | 20 parts |
| Polycarbonate (PC-1: manufactured by Mitsubishi Gas Chemicals Co., Ltd.) | 30 parts |
| Hydrophobic Silica (mean primary particle diameter: 40 nm, hexylmethyl disilazane, hydrophobicity degree: 76%) | 3 parts |
| Anti-oxidant (LS2626: manufactured by Sankyo Co., Ltd.) | 0.6 parts |
| 1,3-dioxorane | 600 parts |
| Silicone oil (KF-54: manufactured by Shin-Etsu Chemical Co., Ltd.) | 0.1 part |

The above component was mixed and circulating dispersed by a circulating homogenizer capable of irradiation of ultrasonic waves, resulting in preparation of a front surface layer coating solution. This coating solution was coated on the aforesaid first charge transporting layer by means of a circular volume controlling type coating method to coat the second charge transporting layer so as to make a dry layer thickness of 5 μm of the second charge transporting layer, and followed by being dried at 110° C. for 70 minutes, resulting in preparation of photoreceptor 1. A cylindricity of photoreceptor 1 was 8 μm.

Preparation of Photoreceptors 2-4

Photoreceptors 2-4 were prepared in a similar manner to photoreceptor 1, except that cylindrical substrate A-1 was replaced by A-2-A-4. Cylindricity of these photoreceptors was 26 μm, 35 μm and 29 μm, respectively.

Preparation of Photoreceptor 5 (Photoreceptor for Comparative Example)

Photoreceptors 5 was prepared in a similar manner to photoreceptor 1, except that cylindrical substrate A-1 was replaced by B-1. A cylindricity of photoreceptors 5 was 44 μm.

Preparation of Toner and Developer (Latex Preparation Example 1)

A solution in which 7.08 g of an anionic surfactant (sodium dodecylbenzene sulfonate: SDS) had been dissolved in ion exchanged water (2760 g) in advance was added in a separable flask of 5000 ml equipped with a stirring device, a temperature sensor, a condenser and a nitrogen introducing device. The inside temperature was raised up to 80° C. while stirring the solution at 230 rpm in a stream of nitrogen. On the other hand, 72.0 g of exemplary compound (19) were added into monomers comprising 115.1 g of styrene, 42.0 g of n-butylacrylate and 10.9 g of methacrylic acid, and dissolved by being heated at 80° C., resulting in preparation of a monomer solution.

Then, the above heated solution was mixing homogenized by use of a mechanical homogenizer provided with a circulating path, resulting in preparation of emulsified particles having a uniform dispersed particle diameter. Successively, a solution in which 0.84 g of a polymerization initiator (potassium persulfate: KPS) had been dissolved in 200 g of ion-exchanged water was added to the resulting system, which was heated at 80° C. and stirred for 3 hours to prepare latex particles.

Subsequently, a solution in which 7.73 g of a polymerization initiator (KPS) had been dissolved in 240 ml of ion-exchanged water was further added and 15 minutes thereafter, a mixed solution of 383.6 g of styrene, 140.0 g of n-butylacrylate, 36.4 g of methacrylic acid and 14.0 g of n-octyl-3-

PC-1

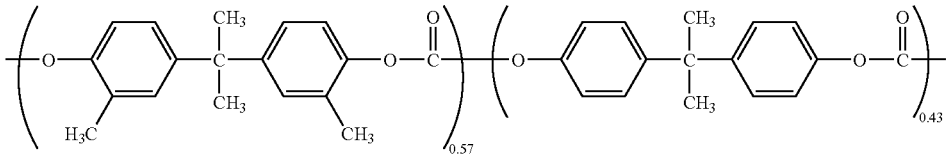

T-1

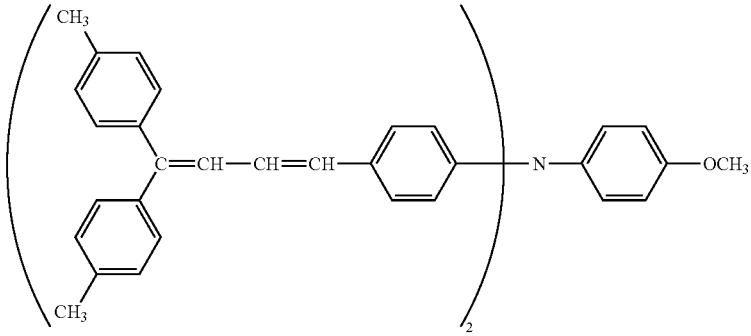

mercaptopropionic acid ester was added drop-wise over time duration of 120 minutes. The solution was heated and stirred for 60 minutes after completing the drop-wise addition, and was cooled down to 40° C. resulting in preparation of latex particles. This latex particles are designated as latex 1.

(Toner Preparation Example) Manufacturing of Colored Particles 1Bk

Sodium n-dodecylsulfate of 9.2 g was dissolved with stirring in 160 ml of ion-exchanged water; Legal 330R (carbon black, manufactured by Cabot Corp.) of 20 g was gradually added to this solution while being stirred, followed by being homogenized by use of CLEARMIX. Particle diameter of the above dispersion was measured by use of Electrophoretic Light Scattering Meter ELS-800, produced by Otsuka Electronics Co., Ltd., to determine a weight average diameter of 112 nm. This dispersion was designated as "colorant dispersion 1".

The above-described "latex 1" of 1250 g, 2000 ml of ion-exchanged water and "colorant dispersion 1" were charged and stirred in a four-necked flask of 5 liter equipped with a temperature sensor, a condenser, a nitrogen introducing device and a stirring device. After the temperature of the solution was adjusted to 30° C., sodium hydroxide aqueous solution of 5 mol/l was added to adjust the pH to 10.0.

Next an aqueous solution, in which 52.6 g of magnesium chloride hexahydrate were dissolved in 72 ml of ion-exchanged water, was added with stirring at 30° C. in 5 minutes. Then, after the solution had been stood for 2 minutes, heating was started to heat the solution up to 90° C. during 5 minutes (heating rate: 12° C./min). In that state the particle diameter was measured by a Coulter Counter TA-II and an aqueous solution, in which 115 g of sodium chloride was dissolved in 700 ml of ion-exchanged water, was added when the volume average particle diameter reached 4.3 μm to stop particle growth, and successively the solution was stirred at a solution temperature of 85° C.±2° C. for 8 hours while being heated, resulting in salting out/fusing.

Thereafter, the system was cooled down to 30° C. under a condition of 6° C./min, and was added with hydrochloric acid to adjust the pH to 2.0 and stirring was stopped. Resulting colored particles were filtered/washed under the following conditions, then being dried with warm air of 40° C. to prepare colored particles. This is designated as "colored particles 1Bk".

Manufacturing of Colored Particles 2Bk-11Bk

Colored particles 2Bk-11Bk were manufactured in a similar manner to colored particles 1 Bk except that manufacturing conditions related to salting out/fusing were changed as shown in Table 1.

TABLE 1

| Colored particles No. | Magnesium chloride addition amount | Temperature raising speed | Salting out/fusing Liquid temperature | Salting out/fusing Standing time | Particle diameter at stop of growth (μm) |
|---|---|---|---|---|---|
| Colored particles 1Bk | 52.6 g | 12° C./min | 85 ± 2° C. | 8 hours | 4.3 |
| Colored particles 2Bk | 52.6 g | 20° C./min | 90 ± 2° C. | 6 hours | 4.3 |
| Colored particles 3Bk | 52.6 g | 5° C./min | 90 ± 2° C. | 6 hours | 4.1 |

TABLE 1-continued

| Colored particles No. | Magnesium chloride addition amount | Temperature raising speed | Salting out/fusing Liquid temperature | Salting out/fusing Standing time | Particle diameter at stop of growth (μm) |
|---|---|---|---|---|---|
| Colored particles 4Bk | 26.3 g | 12° C./min | 85 ± 2° C. | 8 hours | 4.3 |
| Colored particles 5Bk | 78.9 g | 12° C./min | 85 ± 2° C. | 8 hours | 4.3 |
| Colored particles 6Bk | 52.6 g | 12° C./min | 85 ± 2° C. | 8 hours | 3.5 |
| Colored particles 7Bk | 38.6 g | 12° C./min | 85 ± 2° C. | 8 hours | 3.4 |
| Colored particles 8Bk | 78.9 g | 12° C./min | 85 ± 2° C. | 8 hours | 3.2 |
| Colored particles 9Bk | 52.6 g | 12° C./min | 85 ± 2° C. | 8 hours | 5.6 |
| Colored particles 10Bk | 45.8 g | 12° C./min | 85 ± 2° C. | 8 hours | 6.8 |
| Colored particles 11Bk | 52.6 g | 12° C./min | 85 ± 2° C. | 8 hours | 8.9 |

Next, hydrophobic silica (number average primary particle diameter: 12 nm, hydrophobicity: 68) of 1 weight % and hydrophobic titanium oxide (number average primary particle diameter: 20 nm, hydrophobicity: 63) of 1 weight % were added into the above each "colored particle 1Bk"-"colored particle 11Bk", and the system was mixed with a Henschel mixer to prepare toners. These are designated as "toner lBk"-"toner 11Bk". Such as mean particle diameters and particle size distributions of these toners are shown in Table 2. These toners were mixed with a carrier, comprising ferrite particles having a mean particle diameter of 45 μm coated with insulating resin, to be utilized as two-component developer, and a developer number was attached corresponding to each toner. That is, a developer number corresponding to toner 1Bk was developer 1Bk, and the rest was similar.

Herein, with respect to physical properties such as a mean particle diameter and a particle size distribution, the values show no essential differences when they are measured with respect to either colored particles or toners (generally, comprising colored particles incorporated with an external additive).

TABLE 2

| Toner No. | 50% volume average particle diameter (Dv50) (μm) | 50% number average particle diameter (Dp50) (μm) | Dv50/Dp50 | Cumulative 75% volume average particle diameter (Dv75) (μm) | Cumulative 75% number average particle diameter (Dp75) (μm) | Dv75/Dp75 | % by number of particles having (0.7 × Dp50) or less |
|---|---|---|---|---|---|---|---|
| 1Bk | 4.6 | 4.3 | 1.07 | 4.1 | 3.8 | 1.08 | 7.8 |
| 2Bk | 4.8 | 4.5 | 1.07 | 4.2 | 3.7 | 1.14 | 5.5 |
| 3Bk | 4.4 | 4.0 | 1.10 | 4.0 | 3.4 | 1.18 | 8.2 |
| 4Bk | 4.6 | 3.7 | 1.24 | 4.0 | 3.1 | 1.29 | 13.6 |
| 5Bk | 4.7 | 4.3 | 1.09 | 4.1 | 3.6 | 1.14 | 6.3 |
| 6Bk | 3.5 | 3.1 | 1.13 | 3.1 | 2.8 | 1.11 | 6.8 |
| 7Bk | 3.8 | 3.4 | 1.12 | 3.3 | 2.7 | 1.23 | 12.4 |
| 8Bk | 3.6 | 3.3 | 1.09 | 3.1 | 2.8 | 1.11 | 6.3 |
| 9Bk | 5.8 | 5.3 | 1.09 | 5.1 | 4.5 | 1.13 | 8.4 |
| 10Bk | 7.1 | 6.4 | 1.11 | 6.3 | 5.3 | 1.19 | 11.0 |
| 11Bk | 9.3 | 8.8 | 1.06 | 7.9 | 6.9 | 1.14 | 6.3 |

Preparation of Intermediate Transfer Member

An endless belt of silicone rubber mixed with carbon black (volume resistivity: $1\times10^8$ Ω·cm) was utilized and six types of intermediate transfer members were prepared by varying the surface roughness Rz by means of sand blast processing to be 0.5, 1.0 and 1.8.

Evaluation

The above-described photoreceptors 1-5 and developers 1 Bk-11 Bk were combined as shown in Table 3, a cleaning means shown in FIG. 5 being mounted as a cleaning means for a photoreceptor of a digital color printer provided with an intermediate transfer member shown in FIG. 1 as an evaluation machine, and 20000 sheets of A4 prints of images, comprising a mixture of characters and halftone having an image ratio of 8%, were continuously performed under high temperature and high humidity (30° C., 80% RH) by combining a photoreceptor, an intermediate transfer member and a nipping amount of a cleaning blush with said digital color printer as shown in table 3, followed by evaluation. Evaluation items and evaluation criteria are shown below. Further the results are shown in Table 3.

Evaluation Items and Evaluation Criteria

Rz of an intermediate transfer member was evaluated according to the method described before.

(Cleaning Property)

Generation of escape of toner due to abrasion between a photoreceptor and a cleaning blade was evaluated.

A: No generation of escape of toner until completion of 20000 sheets print,

B: No generation of escape of toner until completion of 10000 sheets print,

C: Some generation of escape of toner at less than 10000 sheets print.

(Image Unevenness)

Evaluated was generation of density unevenness (primarily uneven transfer) in a uniform density halftone image having a reflection density of 0.3.

A: No generation of density unevenness in a halftone image until completion of 20000 sheets print, B: Generation of light density unevenness having a density difference of less than 0.03 in a halftone image before completion of 20000 sheets print, C: Generation of distinct density unevenness having a density difference of not less than 0.03 in a halftone image at less than 20000 sheets print.

(Hollow Characters)

Characters were observed at magnification to visually observe presence of hollow characters.

The evaluation criteria are as follows:

A: No generation of significant hollow characters until completion of 20000 sheets print, B: No generation of significant hollow characters until completion of 10000 sheets print, C: Generation of significant hollow characters at less than 10000 sheets print.

(Scattering of Character)

A halftone image of 10% was formed on the whole image plane in stead of a dot image which constitutes characters, and toner scattering around the dots was observed through a loupe.

A: Few toner scattering was observed until completion of 100000 sheets print.

B: Few toner scattering was observed until completion of 50000 sheets print.

C: Increasing toner scattering was observed at less than 50000 sheets print.

(Image Evaluation)

A character image and a halftone image were visually observed after completing 20000 sheets print.

The results of the visual evaluation are shown in Table 3.

(Other Evaluation Conditions)

A line speed for image formation: L/s=180 mm/s,

A charging conditions of a photoreceptor: A potential of a non-image portion was detected by a potential sensor to be made feed-back controllable and a controllable range thereof was −500--900V. The surface potential of a photoreceptor when totally exposed was adjusted to a range of −50-0V.

A light source for image exposure: A semiconductor laser (wavelength: 780 nm)

A development condition: Employed was reversal development as a developing method.

A primary transfer conditions: Primary transfer rollers (5Y, 5M, 5C and 5K of FIG. 1 (each 6.05 mmΦ)) were constituted of a core metal covered with an elastic rubber. The surface specific resistance was $1\times10^6$ Ω and a transfer surface pressure was varied as shown in Table 3. Further, a transfer voltage was also applied.

A secondary transfer conditions: Endless belt-form intermediate transfer member 70 as an intermediate transfer member, and back-up roller 74 and secondary transfer roller 5A which sandwich said transfer member, were arranged, a resistance of back-up roller 74 being $1\times10^6$ Ω, a resistance of secondary transfer roller being $1\times10^6$ Ω, and constant current control (approximately 80 μA) was applied.

Fixing was performed by means of a heat fixing method with a fixing roller, inside of which a heater was arranged. A distance Y on an intermediate transfer member between the first contact point of an intermediate transfer member and a photoreceptor to that of the next color photoreceptor was set to 95 mm.

The outside circumferential lengths (length of circumference) of driving roller 71, guide rollers 72 and 73, and back-up roller for secondary transfer 74 were set to 31.67 mm (=95 mm/3), and the outside circumferential length of tension roller 76 was set to 23.75 mm (=95 mm/4).

And the outside circumferential length of primary transfer roller was set to 19 mm (=95 mm/5).

A cleaning means for a photoreceptor: Employed were, a cleaning blade comprising rubber elastic body having a rebound elasticity of 55%, a cleaning blush made of conductive acrylic resin, brush fur density of $3\times10^3/cm^2$, and three types of nip amount of 0.6, 1.0 and 1.3 mm.

A secondary transfer roller (5A of FIG. 1): Employed were a constitution of a core metal covered with elastic rubber, application with a transfer voltage.

A cleaning means for an intermediate transfer member: Employed was a cleaning blade comprising rubber elastic body having a rebound elasticity of 40% with the presence of a cleaning roller.

TABLE 3

| Combination No. | Photoreceptor No. (cylindricity: μm) | Developer No. | Transfer surface pressure of primary transfer roller ($g/cm^2$) | Rz of intermediate transfer member (μm) | Nip amount of cleaning blush (mm) |
|---|---|---|---|---|---|
| 1 | 2 (26) | 1 | 0.15 | 1.0 | 1.0 |
| 2 | 2 (26) | 2 | 0.25 | 1.0 | 1.0 |
| 3 | 2 (26) | 3 | 0.15 | 0.5 | 1.0 |
| 4 | 2 (26) | 4 | 0.15 | 1.0 | 1.0 |
| 5 | 2 (26) | 5 | 0.15 | 1.8 | 1.0 |
| 6 | 2 (26) | 6 | 0.15 | 1.0 | 1.3 |
| 7 | 2 (26) | 7 | 0.15 | 1.0 | 1.0 |
| 8 | 2 (26) | 8 | 0.15 | 1.0 | 0.6 |
| 9 | 2 (26) | 9 | 0.40 | 1.0 | 1.0 |
| 10 | 2 (26) | 10 | 0.15 | 1.0 | 1.0 |
| 11 | 2 (26) | 11 | 0.15 | 1.0 | 1.0 |
| 12 | 1 (8) | 1 | 0.15 | 1.0 | 1.0 |
| 13 | 3 (35) | 1 | 0.15 | 1.0 | 1.0 |
| 14 | 4 (29) | 1 | 0.15 | 1.0 | 1.0 |
| 15 | 5 (44) | 1 | 0.15 | 1.0 | 1.0 |

| Combination No. | Cleaning property | Unevenness of image | Hollow characters | Scattering of characters | Image evaluation | Remarks |
|---|---|---|---|---|---|---|
| 1 | A | A | A | A | A*1 | In the invention |
| 2 | A | A | A | A | A*1 | In the invention |
| 3 | A | A | B | A | A*1 | In the invention |
| 4 | C | B | C | C | C*3 | Out of the invention |
| 5 | A | A | A | A | A*1 | In the invention |
| 6 | A | A | A | A | A*1 | In the invention |
| 7 | C | B | C | B | C*3 | Out of the invention |
| 8 | A | A | A | B | A*1 | In the invention |
| 9 | A | A | B | A | A*1 | In the invention |
| 10 | C | B | C | B | B*2 | Out of the invention |
| 11 | A | A | A | A | A*1 | In the invention |
| 12 | A | A | A | A | A*1 | In the invention |
| 13 | B | B | B | B | A*1 | In the invention |

TABLE 3-continued

| | | | | | | |
|---|---|---|---|---|---|---|
| 14 | A | B | A | B | A*1 | In the invention |
| 15 | C | C | C | B | C*3 | Out of the invention |

*1Excellent in both of character and halftone images
*2Deterioration of sharpness in character images
*3Deterioration in both character and halftone images It is clear from Table 3 that combination Nos. 1-3, 5, and Nos. 11-14, in which a latent image on a cylindrical photoreceptor having a cylindricity of 5-40 μm was developed with a developer utilizing a toner provided with the all characteristics of the following (1)-(3), shows improvement in a cleaning property, decreased image defects such as image unevenness, hollow characters and scattering of characters as well as excellent sharpness in both of a character image and a halftone image. On the other hand, combination No. 4 which does not satisfies this condition (toner is out of the condition) is inferior in a cleaning property, hollow characters and scattering of characters, Nos. 7 and 10 (toner is out of the condition) deteriorated a cleaning property and hollow characters resulting in poor sharpness of a character image and a halftone image. Further, combination No. 15 in which toner satisfies all the characteristics of (1)-(3) described below but using photoreceptor having a cylindricity of 44 μm also shows a deteriorated cleaning property, unevenness of images and hollow characters, resulting in deteriorated sharpness.

(1) A ratio (Dv/Dp) of 50% volume particle diameter of toner (Dv50) to a 50% number particle diameter of toner (Dp50) is 1.0-1.15.

(2) A ratio (Dv75/Dp75) of a cumulative 75% volume particle diameter from the largest volume particle diameter (Dv75) to a cumulative 75% number particle diameter from the largest number particle diameter (Dp75) is 1.0-1.20.

(3) In the whole toner, a number of toner particles having a particle diameter of not more than 0.7×(Dp50) is 10% or less by number.

Example 2

Six types of toners 1Y, 1M, 1C, 4Y, 4M and 4C shown in Table 4, which have such as shape factors similar to those of toners 1Bk and 4Bk and 4C, were prepared in a similar manner to preparation of the toners utilized in example 1, except that C. I. Pigment Yellow 185 (Y toner), C. I. Pigment 122 (M toner) and C. I. Pigment 15:3 (C toner) were utilized instead of Regal 330R (carbon black, manufactured-by Cabot Corp.) in a colorant dispersion.

TABLE 4

| Toner No. | 50% volume average particle diameter (Dv50) (μm) | 50% number average particle diameter (Dp50) (μm) | Dv50/Dp50 | Cumulative 75% volume average particle diameter (Dv75) (μm) | Cumulative 75% number average particle diameter (Dp75) (μm) | Dv75/Dp75 | *1 |
|---|---|---|---|---|---|---|---|
| 1Y | 4.6 | 4.3 | 1.07 | 4.0 | 3.8 | 1.05 | 7.8 |
| 1M | 4.6 | 4.3 | 1.07 | 4.2 | 3.9 | 1.08 | 7.9 |
| 1C | 4.6 | 4.3 | 1.07 | 4.1 | 3.8 | 1.08 | 7.8 |
| 4Y | 4.6 | 3.8 | 1.21 | 4.0 | 3.1 | 1.29 | 13.6 |
| 4M | 4.6 | 3.9 | 1.17 | 4.0 | 3.2 | 1.25 | 13.2 |
| 4C | 4.6 | 3.8 | 1.21 | 4.0 | 3.0 | 1.33 | 14.6 |

*1; % by number of particles having (0.7 × Dp50) or less

[Manufacturing of Developer]

Developers 1Y, 1M, 1C, 4Y, 4M and 4C for evaluation were prepared by mixing the above-described toners 1Y, 1M, 1C, 4Y, 4M and 4C of each 10 weight % and 100 weight % of a carrier comprising a core of ferrite particles covered with insulating resin.

Image evaluation similar to example 1 was performed utilizing developer group 1 of developer 1Bk, 1Y, 1M and 1C and developer group 4 of developer 4Bk, 4Y, 4M and 4C. Herein, 10000 sheets of a color image according to an intermediate transfer method were printed under conditions similar to example 1 except employing the same conditions of photoreceptor 2 (cylindricity of 26 μm), a transfer surface pressure of 0.15 g/cm$^2$, a Rz of the intermediate transfer member of 1.0 and a nip amount of cleaning of 1.0 mm. As a result, color images which utilized developer group 1 exhibited no generation of image defects such as hollow characters and scattering of characters, resulting in images having excellent sharpness, while color images which utilized developer group 4 showed significant hollow characters around over 1000 sheets print, and increasing generation of scattering of characters around over 3000 sheets print, resulting in increasing deterioration of sharpness.

In the examples shown above, improvement of toner transfer characteristics of electrophotography employing an intermediate transfer member has been achieved, and image defects such as hollow characters and scattering of characters which may be generated due to decreased toner transfer can be prevented as well as an image forming method and an image forming apparatus based on an electrophotographic method having an excellent cleaning property can be provided.

What is claimed is:

1. An image forming method comprising:

developing a latent image formed on a cylindrical electrophotographic photoreceptor having a cylindricity of 5 to 40 μm, with a developer comprising toner in which a ratio Dv50/Dp50 of a 50% volume particle diameter Dv50 to a 50% number particle diameter Dp50 is 1.0 to 1.15, a ratio Dv75/ Dp75 of a cumulative 75% volume particle diameter from the largest volume particle diameter Dv75, to a cumulative 75% number particle diameter from the largest number particle diameter Dp75, is 1.0 to 1.20, and the number of toner particles having a particle diameter of 0.7×Dp50 or less is 10 percent by number or less, to form a toner image, the developer is provided from a development device;

transferring the toner image from the photoreceptor to an intermediate transferring member, and supplying a surface energy lowering agent to the cylindrical electrophotographic photoreceptor from a surface energy lowering agent supplying device, wherein the cylindrical electrophotographic photoreceptor has a layer which contacts the toner in the developing step, and the layer has inorganic particles having a number average primary particle diameter of 1 nm to less than 100 nm.

2. The method of claim 1, wherein the 50% volume particle diameter Dv50 of the toners is 2 μm to 8 μm.

3. The method of claim 1, wherein the toner particles contain colored particles which are obtained by polymerizing polymerizable monomers in an aqueous medium.

4. The method of claim 1, wherein the toner particles contain colored particles which are obtained by salting-out/fusing at least resin particles in an aqueous medium.

5. The method of claim 1, wherein the cylindricity of the photoreceptor is 7 to 30 μm.

6. The method of claim 1, wherein the cylindricity of the photoreceptor is 7 to 27 μm.

7. The method of claim 1, wherein the ratio Dv50/Dp50 of the 50% volume particle diameter Dv50 to the 50% number particle diameter Dp50 is 1.0 to 1.13.

8. The method of claim 1, further comprising:

transferring the toner image on the intermediate transferring member to a recording medium; and removing a residual toner on the photoreceptor after the toner image is transferred to the intermediate transferring member.

9. The method of claim 8, wherein the cylindricity of the photoreceptor is 7 to 30 μm.

10. The method of claim 8, wherein the cylindricity of the photoreceptor is 7 to 27 μm.

11. The method of claim 9, wherein the ratio Dv50/Dp50 is 1.0 to 1.13.

12. An image forming method comprising:

developing a latent image formed on a cylindrical electrophotographic photoreceptor having a cylindricity of 5 to 40 μm, with at least one of a yellow, a cyan, a magenta or a black toner having a ratio Dv50/Dp50 of a 50% volume particle diameter Dv50 to a 50% number particle diameter Dp50 of 1.0 to 1.15, a ratio Dv75/ Dp75 of a cumulative 75% volume particle diameter from the largest volume particle diameter Dv75, to a cumulative 75% number particle diameter from the largest number particle diameter Dp75, of 1.0 to 1.20, and the number of toner particles having a particle diameter of 0.7×Dp50 or less of 10 percent by number or less, to form a toner image, the at least either one of a yellow, a cyan, a magenta or a black toner is provided from a development device;

transferring the toner image from the cylindrical electrophotographic photoreceptor to an intermediate transferring member, and supplying a surface energy lowering agent to a surface layer of the cylindrical electrophotographic photoreceptor from a surface energy lowering agent supplying device, during the image forming is performed, wherein the surface layer has inorganic particles having number average primary particle diameter of 1 nm to less than 100 nm.

13. A color image forming method comprising:

developing latent images each for a black toner image, yellow toner image, cyan toner image and magenta toner image, and each formed on a predetermined cylindrical electrophotographic photoreceptor having a cylindricity of 5 to 40 μm, with a yellow toner, a cyan toner, a magenta toner and a black toner corresponding to the latent images, wherein at least one of the toners has a ratio Dv50/Dp50 of a 50% volume particle diameter Dv50 to a 50% number particle diameter Dp50 being 1.0 to 1.15, a ratio Dv75/ Dp75 of a cumulative 75% volume particle diameter from the largest volume particle diameter Dv75, to a cumulative 75% number particle diameter from the largest number particle diameter Dp75, being 1.0 to 1.20, and the number of toner particles having a particle diameter of 0.7×Dp50 or less, each of the toners is provided from each one of development devices;

transferring the either yellow, magenta, cyan of black toner images from the predetermined cylindrical electrophotographic photoreceptor to an intermediate transferring member, and supplying a surface energy lowering agent to the predetermined cylindrical electrophotographic photoreceptor from a surface energy lowering agent supplying device, wherein the, predetermined cylindrical electrophotographic photoreceptor has a layer which contacts at least one of the toners in the developing step, and the layer has inorganic particles having a number average primary particle diameter of 1 nm to less than 100 nm.

14. The image forming method of claim 12, wherein each of the yellow, magenta, cyan and black toners has the ratio Dv50/Dp50 of 1.0 to 1.15, the ratio Dv75/ Dp75 of 1.0 to 1.20, and the number of toner particles having a particle diameter of 0.7×Dp50 or less being 10 percent by number or less.

15. The image forming method of claim 14, wherein each of the 50% volume particle diameter Dv50 of the toners being 2 μm to 8 μm.

16. The image forming method of claim 14, wherein each of the toners contains colored particles obtained by polymerizing polymerizable monomers in an aqueous medium.

17. The image forming method of claim 14, wherein each of the toners contains colored particles obtained by salting-out/fusing at least resin particles in an aqueous medium.

18. The image forming method of claim 14, wherein the cylindricity of each of the cylindrical electrophotographic photoreceptors is 7 to 30 μm, and each of the toners has the ratio Dv50/Dp50 of 1.0 to 1.13.

* * * * *